US009003733B1

(12) United States Patent
Simpson et al.

(10) Patent No.: US 9,003,733 B1
(45) Date of Patent: Apr. 14, 2015

(54) STANDING SEAM STRENGTHENING APPARATUS

(75) Inventors: Harold G. Simpson, Edmond, OK (US); Leo E. Neyer, Edmond, OK (US)

(73) Assignee: Harold Simpson, Inc., Edmond, OK (US)

( * ) Notice: Subject to any disclaimer, the term of this patent is extended or adjusted under 35 U.S.C. 154(b) by 0 days.

(21) Appl. No.: 13/179,406

(22) Filed: Jul. 8, 2011

Related U.S. Application Data

(63) Continuation of application No. 11/904,796, filed on Sep. 28, 2007, now Pat. No. 7,984,596.

(60) Provisional application No. 60/848,502, filed on Sep. 29, 2006.

(51) Int. Cl.
*E04D 3/362* (2006.01)
*E04B 7/20* (2006.01)

(52) U.S. Cl.
CPC ..... *E04B 7/20* (2013.01)

(58) Field of Classification Search
USPC ..... 52/478, 520, 536, 537, 545, 547, 528, 52/550, 489.1
See application file for complete search history.

(56) References Cited

U.S. PATENT DOCUMENTS 4,034,532 A * 7/1977 Reinwall, Jr. ..... 52/520
4,139,974 A * 2/1979 Fox ..... 52/404.2
4,168,596 A * 9/1979 Yoder, Jr. ..... 52/462
4,193,247 A * 3/1980 Heckelsberg ..... 52/713
4,296,581 A * 10/1981 Heckelsberg ..... 52/520
4,351,140 A * 9/1982 Simpson ..... 52/542
4,423,581 A * 1/1984 Miller ..... 52/519
4,522,005 A * 6/1985 Seaburg et al. ..... 52/544
4,546,586 A * 10/1985 Knudson ..... 52/469
4,570,404 A * 2/1986 Knudson ..... 52/520
4,649,684 A * 3/1987 Petree et al. ..... 52/395
4,987,716 A * 1/1991 Boyd ..... 52/520
5,001,881 A * 3/1991 Boyd ..... 52/545
5,134,825 A * 8/1992 Berridge ..... 52/520
5,222,340 A * 6/1993 Bellem ..... 52/463
5,222,341 A * 6/1993 Watkins et al. ..... 52/547
5,241,785 A * 9/1993 Meyer ..... 52/520
5,379,517 A 1/1995 Skelton
5,606,838 A * 3/1997 Hughes et al. ..... 52/713
5,715,640 A * 2/1998 Haddock ..... 52/545
5,737,894 A 4/1998 Simpson et al.
5,867,959 A * 2/1999 Ruble et al. ..... 52/545
6,301,853 B1 10/2001 Simpson et al.
6,889,478 B1 5/2005 Simpson
6,904,730 B2 * 6/2005 Mitchell ..... 52/536
7,281,359 B2 * 10/2007 Marshall ..... 52/712
7,574,839 B1 8/2009 Simpson
7,703,256 B2 * 4/2010 Haddock ..... 52/543
7,874,117 B1 * 1/2011 Simpson ..... 52/520
2003/0145548 A1 8/2003 Mitchell (Continued)

*Primary Examiner* — Robert Canfield
(74) *Attorney, Agent, or Firm* — Hall Estill Attorneys at Law

(57) ABSTRACT

A standing seam roof assembly is formed by overlapping adjacent panels, the female sidelap portion of one panel forming a male insertion cavity to receive a male sidelap portion of a second panel to form a standing seam, a clip configured to connect the standing seam to an underlying support structural. A strengthening beam is incorporated in the standing seam at a selected point along the standing seam to increase load bearing capacity. In one preferred embodiment, the strengthening beam is incorporated into the connecting clip.

11 Claims, 25 Drawing Sheets

(56) References Cited

U.S. PATENT DOCUMENTS

| | | | |
|---|---|---|---|
| 2005/0055903 | A1 | 3/2005 | Greenberg |
| 2005/0193644 | A1 | 9/2005 | Simpson et al. |
| 2005/0204674 | A1 | 9/2005 | Marshall |
| 2005/0246992 | A1 | 11/2005 | Rood, Jr. |
| 2009/0044477 | A1 | 2/2009 | Simpson et al. |
| 2009/0126303 | A1 | 5/2009 | Ferge et al. |

* cited by examiner

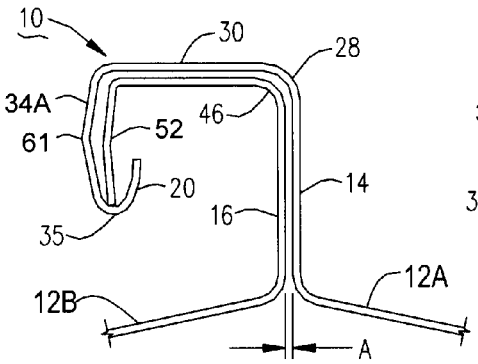
FIG. 4C
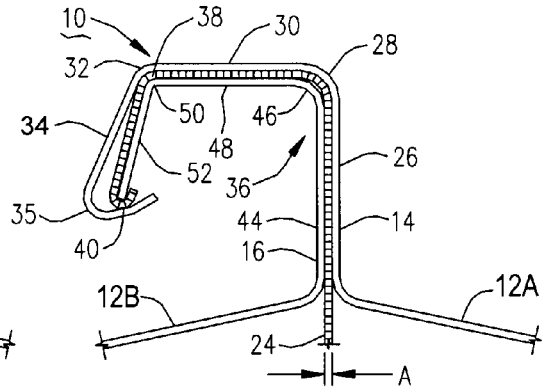
FIG. 4D
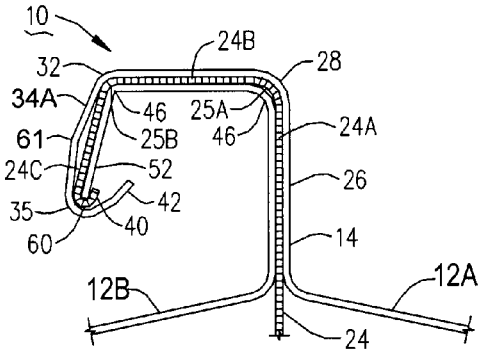
FIG. 4E
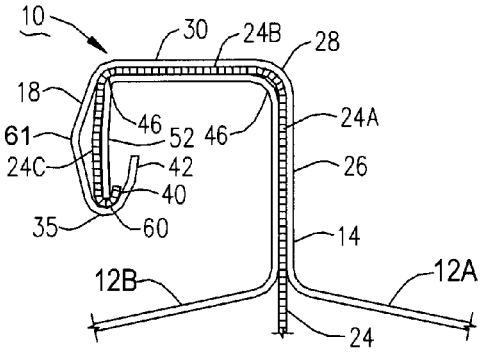
FIG. 4F
FIG. 4G
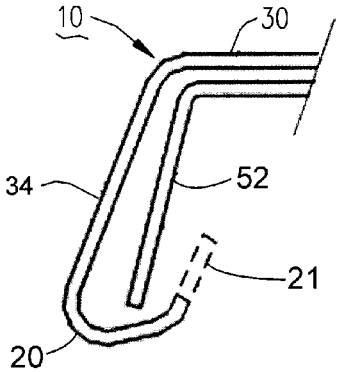

FIG. 7
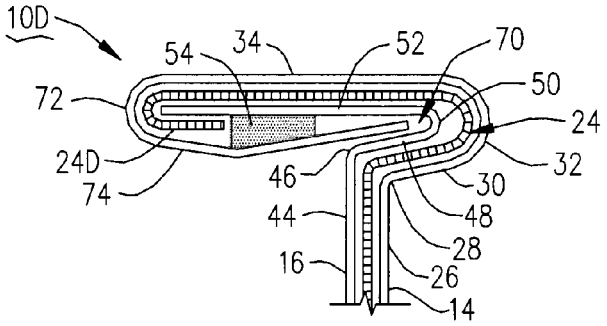
FIG. 8
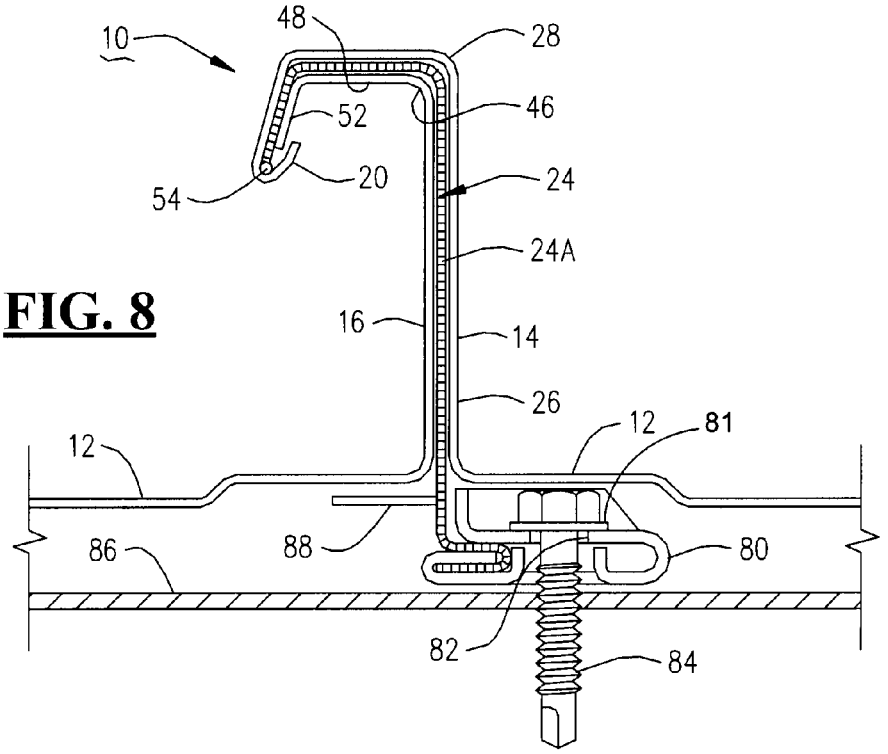
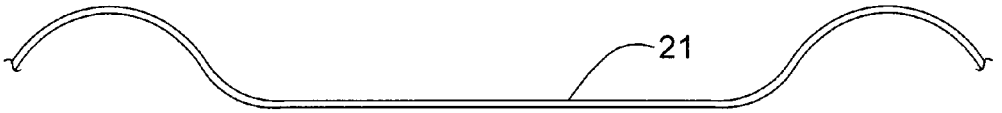
FIG. 9

STANDING SEAM STRENGTHENING APPARATUS

RELATED APPLICATIONS

The present application is a continuation application of U.S. patent application Ser. No. 11/904,796 filed Sep. 28, 2007 and which is now U.S. Pat. No. 7,984,596, entitled "Roof Assembly Improvements Providing Increased Load Rearing," which claims priority to U.S. Provisional Application No. 60/848,502 filed Sep. 29, 2006, entitled "Roof Assembly Improvements Providing Increased Load Bearing."

BACKGROUND OF THE INVENTION

1. Field of the Invention

The present invention relates to a roof assembly for a building structure, and more particularly, but not by way of limitation, to roof assembly improvements providing greater load bearing capabilities.

2. Discussion

An exposed metal roof has become the preferred roof for most commercial and industrial building systems in the USA. An exposed metal roof typically comprises steel metal panels anchored to structural support members, the metal panels having a selected thickness. The most common thicknesses are 22, 24 and 26 gauges. The metal panels are formed by various means to provide structural strength sufficient to resist roof traffic, live load (snow and pounding water) and wind loading, which results in uplift.

Steel panels provide a widely accepted weather membrane. If coated with a whether resistance coating the panels can last 30 to 40 years with little maintenance. Steel panels in sheet form are not practical for roofing without some forming to provide resistance deformation by live loading, including wind loads. This typically consists of forming corrugations in the steel sheets to form roof panels. Typical panels are 12 inches to 36 inches wide, depending on the type of corrugation and type of roof.

Metal roofs can be classified into two broad types, corrugated screw down roofs and standing seam roofs. Screws down roofs are roofs which are secured to supporting members by fasteners penetrating the panels. Screws down roofs are typically composed of panels with corrugations at 3 to 6" intervals and are attached to each other; fasteners penetrate the steel panels in the flat between corrugations and along the longitudinal sides of the panels to each other.

Standing seam roofs are attached to underlying supporting structurals by means of clips encased into the seam and attached to the building structurals, the seams being mechanically seamed with the edge seams so that the steel panels are not punctured with fasteners. The present invention is applicable to such standing seam roof systems.

Standing seam roof panels are formed into various shapes but fall into two broad types, pan panels and trapezoidal panels. Pan panels have a vertical leg corrugation at each longitudinal edge of the panel; trapezoidal panels have a trapezoidal corrugation at each longitudinal edge of the panel. Both systems have a seam formed into the top of the corrugations configured to join overlapping panel sides together, and after joined, the seam and corrugation will transfer loads from the panels to the structure.

The panels are attached to the building by means of clips placed on the seams and attached to underlying support structurals. After the seams of two or more panels are joined and clipped to the support structurals, with the clips attaching between the seam elements of adjacent panels, the panel seams are field formed into what is commonly referred to as a lock seam by an electrically powered seamer. The seamer folds the panel edges together, along with the clips, to form a lock seam of various configurations that resists separation of the panels.

This method of attaching panels to each other and to the structural system of the building eliminates the necessity of puncturing the weather resistant steel panels to attach the panels to each other and to the structural system, thus providing a water tight roof with no panel penetrations, avoiding water entry while still providing secure attachment of the roof panels to the support structures.

Because the panels are only attached at their sides only the forces of uplift load and live load are concentrated on the panel corrugations seams. This causes the panel to deflect in the center between longitude seams, and as the panel center is deflected the side corrugations are pulled apart and the seam deflects between clip attachments points, which can result in a failure of the roof panel by pulling the seam apart and or by excessive deflection between building structural attachment points.

Several industry tests determine the strength of a standing seam roof. One such test is the ASTM E 1592 test for uplift; another test is the Factory Mutual FM 4471 test for negative load (wind uplift); and other tests are used for the determination of deflection under live load. In this country, the most severe loading is that of a negative load. During tests for negative loading the panel flat deflects upward as much as 6 inches, placing severe stress on the panel seam. Live loads also deform the panel and stress the seam in a similar but less severe deflection. The result is that the seam unfurls and deflects between spans and failure occurs by buckling of the panel corrugation and seam and separation of the seam. To minimize this several methods have been used and are common in the industry.

One method to improve load capacity of roof panels is to reduce the span of the panels, that is, reducing the distance between underlying support structurals. This is effective to a point, but does not strengthen the panel seam from separation due to unfurling, and is costly because more secondary structurals are required over the entire roof.

Another method common in the industry is to increase the thickness of the panel material from 24 gauge to 22 gauge. This strengthens the seam and does reduce the seam unfurling and some deflection between spans. This method is not cost effective as the material for the entire panel is increased only where the seam and clip attachment points need to be reinforced, and the improvement in the seam strength is minimal.

Another method is to reduce the width of the panel, for example, from 24 inches to 12 inches. This is not cost effective because this requires additional clips, and since each panel has vertical or trapezoidal corrugations at the sides of the panels, additional panel material is required per square foot of roof.

Yet another method that is frequently used to strengthen panels is to attach a clamp over the outside of the corrugation at clip locations. This method does a good job of minimizing the unfurling of the panel seam at clip locations but does not minimize deflection of the panel seam at mid points or deflection either side of the clamp. The clamp will only keep the panel seam from unfurling at the clip location and will not improve defection between clips. The clamps, installed after seaming, are expensive and generally considered unsightly for many applications.

In addition many deficiencies, there is a need for improved means of strengthening standing seam roof assemblies to increase load bearing capabilities.

SUMMARY OF THE INVENTION

The present invention provides a standing seam roof assembly in which adjacent roof panels are supported by underlying support structure in overlapping edge relationship to form a standing seam between adjacent roof panels. The assembly comprises a first roof panel having a female sidelap portion that forms a male insertion cavity and a second roof panel having a male sidelap portion engagable in the male that forms a standing seam assembly when the male sidelap portion is inserted into the female insertion cavity to form the standing seam assembly.

The objects, features and advantages of the present invention will become apparent from the following detailed description when read in conjunction with the drawings and appended claims.

BRIEF DESCRIPTION OF THE DRAWINGS

FIGS. 4A through 4C are elevational, end views of the profile of a male sidelap and a female sidelap of interlocked adjacent roof panels that are interlocked, but ranging from not being mechanically seamed to being partially seamed, to form a standing seam assembly.

FIG. 4D through 4F show corresponding similar views to FIGS. 4A-4C but with a clip hooked over the male sidelap.

FIG. 4G is an enlarged view of the circled area designated 4G in FIG. 4A and showing a variable hook end.

FIG. 7 an elevational view of an alternative standing seam assembly between adjacent panels in the final formed configuration.

FIG. 8 is an elevational view of an alternate standing seam assembly before the field seaming operation is performed.

FIG. 9 is an end view of a portion of the standing seam assembly of FIG. 5, showing a scalloping condition resulting when pre-crimping the hook portion is not applied to the female sidelap edges.

FIG. 36 is a perspective view of a standing seam roof having an interconnected cinch plate and backer beam at the endlap portions of roof panels.

FIG. 38 is a view similar to FIG. 36 in which a strengthening beam is installed to the standing seam roof

FIG. 48 is another perspective view of the clip and beam of FIG. 47 depicted with a clip base.

FIG. 49 is an elevational end view of the clip and base of FIG. 48.

DETAILED DESCRIPTION

Figure 1:
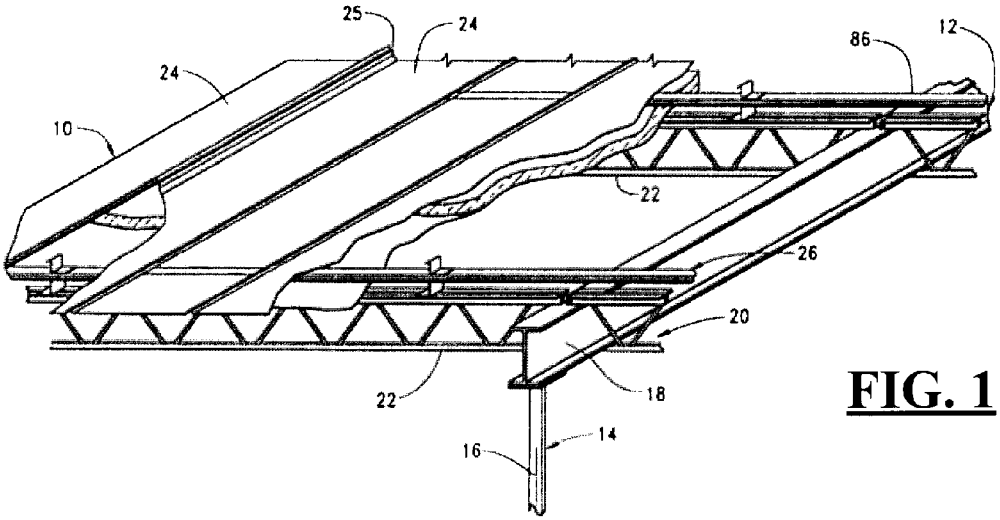
FIG. 1 is an isometric, partial cut-away view of a portion of a standing seam roof system generally illustrating its environment.

Various embodiments will be described herein with reference to the drawing figures, and certain terminology will be utilized insofar as practical and consistent with that which is familiar to those skilled in the pre-engineering building industry.

Whether in a new roof or reinstallation, or in a reroof installation, the roof panels of a standing seam metal roof are secured at the interlocking sidelap joints and at the end overlap of contiguous panels. Fastener penetration of the roof panels, except at the end overlaps and roof perimeters, is avoided to minimize leakage points. To maintain water tightness at points of attachment to underlying structure, the roof panels are permitted to expand and contract in relation to the underlying structure, or the roof panels and the underlying structures must be permitted to move in unison without unduly straining or fracturing the panels. This can be accomplished by limiting the length of the roof panels, or by utilizing support structures sufficiently flexible to allow the attachment means to move with the expansion and contraction of the panels. The flexibility of the support structurals must be greater for longer panel runs because, other factors being equal, the expansion and contraction of the panels will be greater.

Past practice has been common for non-penetrating fasteners to use either a fixed or a sliding clip with a minimum length contact surface between the hold-down portion of the clip and the top of the male leg of the seam. The length of the clip has been held to a minimum, resulting in stress concentrations in the panel at the point of attachment, leading to severe distortion in the panel joints as the panels are subjected to wind uplift.

In conventional standing seams, the standing seam clips engage the male sidelap portions, and the female sidelap portions are field clamped over the male sidelap portions and the clips; thus, the load transferred from the female sidelap portions must pass through the male sidelap portions to the clips where the load, in turn, passes to the building support structures. In this arrangement, there is a tendency for the panel joints to unravel, or unzip, leading to distortions over the short panel portions retained by the clips, potentially resulting in premature panel failure from wind uplift.

A roof panel is usually attached to the underlying building structurals in a manner that causes the roof panel to act as a three or four span continuous beam. This arrangement substantially reduces the maximum moment occurring at any one point compared to the moment that would occur in a simple beam, other factors being equal. However, this can cause a negative moment to occur at the attachment point. This negative moment peaks and drops off very quickly as the panel section moves from the center line of the attaching clips toward the point of inflection (P.I.), the P.I. being where the moment in the panel changes from positive to negative. This being the case, it is advantageous to reinforce the panel corrugations for a major portion of the distance from the point of support to the P.I., because the small amount of material required to reinforce this short distance is more than compensated for by the increased overall strength of the panel.

Past center hold-down practice has been to coordinate usage of floating clips with eave and ridge hold-down means so that, if floating clips are used to attach the center of the panel to the building structural, then fixed clips are used to attach the eave or ridge portions of the panel to the underlying structural. Conversely, if the panel edge attachment consists of floating, (two-piece, moveable) non-penetrating attachment means, such as clips, then the center hold-down is fixed. Even so, non-penetrating floating hold-down devices have heretofore been largely complex and expensive.

The effectiveness of non-penetrating center hold-down devices is influenced by the number and height of corrugations formed in the panel, and by the width, thickness and strength of the metal laterally separating the corrugations. The configuration and number of panel corrugations in turn has a direct impact on the efficiency of material utilization, which is a primary cost factor. Conventional standing seam roofs may only achieve a flat-width-to-coverage ratio as low as 1.25:1 where through fasteners exist only at panel end laps and do not occur at the panel centers. On the other hand, non-standing seam panels with penetrating hold-down fasteners are commonly thirty six (36) inches wide and may achieve flat-width-to-coverage ratios as low as 1.17:1.

Roof panels have a substantially flat pan profile with an upstanding female sidelap portion along one longitudinal edge, and an upstanding male sidelap portion along the opposite edge. The medial portion of the profile usually will have a number of medial corrugations to stiffen the panels. Adjacent roof panels are interlocked with the female sidelap portion wrapped around the male sidelap portion, as will be depicted in several figures included herewith.

Figure 2:
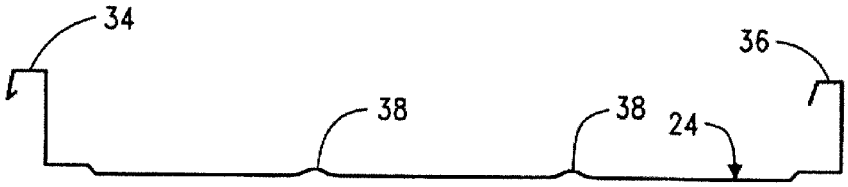
FIG. 2 is an end view profile of a roof panel that can be utilized in the roof system of FIGS. 1 and 1A.
Figure 3:
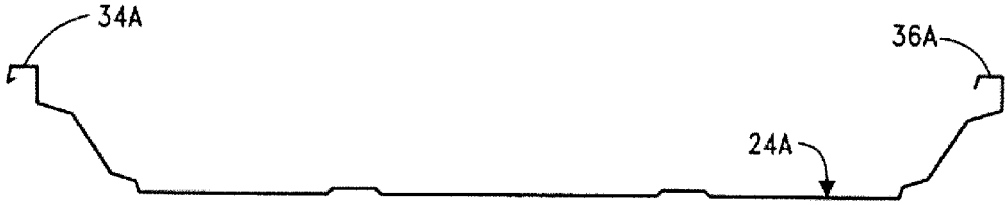
FIG. 3 is an end view profile of an alternative roof panel that can be utilized in the roof system of FIGS. 1 and 1A.

FIGS. 1 Through 3

Figure 1A:
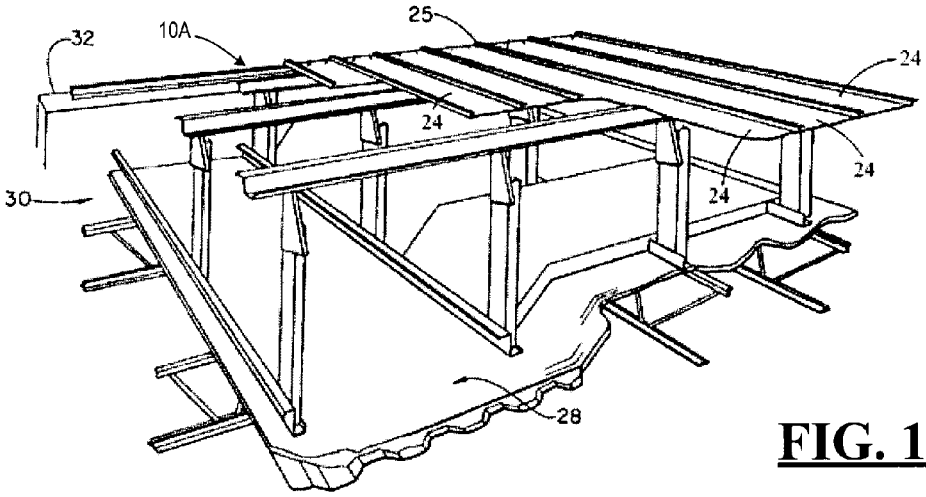
FIG. 1A is an isometric, partial cut-away view of a portion of a re-roof system also illustrating such environment.

Referring to the drawings generally, and more particularly to FIG. 1, shown therein is a pre-engineered building roof 10 as supported by a pre-engineered building structure 12. FIGS. 1 and 1A are included for a general description of the environment of standing seam roof assemblies. It should be noted that the numerical designations will be the same for identical components in FIGS. 1 and 1A.

The pre-engineered structure 12 comprises a primary structural system 14 which consists of a plurality of upwardly extending column members 16 rigidly connected to a foundation (not shown). Also, the primary structural system 14 has a plurality of generally sloping primary beams 18 which are supported by the column members 16.

A secondary structural system 20 comprises a plurality of open web beams 22, also called bar joists, supported by the primary beams 18 generally in horizontal disposition. It will be understood that cee or zee purlins, or wood beams, can be used as the secondary structurals in lieu of the bar joists 22.

A plurality of roof panels 24 are supported over the secondary structural assembly 20 by a plurality of panel support assemblies 26 and are attached to the upper flanges of the bar joists 22. The roof panels 24, only portions of which are shown, are depicted as being standing seam panels with interlocking standing seams 25 connected by clip portions of the panel support assemblies 26.

Also useful in re-roofing installations, FIG. 1A shows a portion of a roof system 10A supported by a preexisting roof 28 of a building structure 30 and a plurality of wall members 32. The preexisting roof 28 can be any preexisting roof structure such as a built-up roof connected to and supported by conventional primary and secondary support elements.

Whether in a new roof as depicted in FIG. 1, or in a re-roofing installation as depicted in FIG. 1A, the roof panels 24 are secured at the interlocking side lap joints and at the end overlap of contiguous panels. Fastener penetration of the roof panels 24, except at the end overlaps and roof perimeters, is avoided to minimize leakage points. To achieve water tightness at points of attachment to underlying structure, the roof panels 24 are permitted to expand and contract in relation to the underlying structure, or the roof panels 24 and the underlying structure are permitted to move in unison without unduly straining or fracturing the panels.

This can be accomplished by limiting the length of the roof panels 24 or by utilizing support structures sufficiently flexible to allow the attachment means to move with the expansion and contraction of the panels. The flexibility of the support structural will be greater for longer panel runs as the expansion and contraction of the panels will be greater.

In FIG. 2, the roof panel 24 has a substantially flat pan profile between a female sidelap portion 34 and a male sidelap portion 36. The medial portion of the roof panel 24 can have a number of corrugations 38 of a selected height for the purpose of stiffening the panel. FIG. 3 shows an alternative roof panel 24A having trapezoidal sidelap portions 34A, 36A to improve the panel material utilization in relation to roof coverage because, all else being equal, the roof panel 24 of FIG. 2 requires a wider metal coil blank than that of the roof panel 24A of FIG. 3. Both panels in FIGS. 2 and 3 are normally formed from 26, 24 or 22 gauge steel coil or 0.032 inch or 0.040 thick aluminum coil.

FIGS. 4A-4F through FIG. 5

The drawings that accompany the following description will disclose and describe various embodiments, and it should be noted that the numerical designations will be the same for identical components.

The reader's attention is now invited to FIGS. 4A-4D, in which is shown a standing seam 10 formed by the edge joinder of adjacent roof panels 12A and 12B to form the roof of a building structure. It should be noted that the numerical designations, although not the same as those for the above described figures, will be the same for the remaining figures for identical components.

A pair of adjacently disposed, side overlapped roof panels 12A, 12B are shown as exemplary standing seam configurations. Each of the roof panels 12A and 12B has a female sidelap portion 14 formed along one edge and a male sidelap portion 16 formed along the opposite edge thereof. Each standing seam is formed by the joining of a female sidelap and a male sidelap, and for the purpose of describing the standing seam 10, the roof panel 12A contributing the female sidelap 14 to the standing seam 10 will be referred to as the female roof panel 12A, and the roof panel 12B contributing the male sidelap 16 to the standing seam 10 will be referred to as the male roof panel 12B.

Figure 4A:
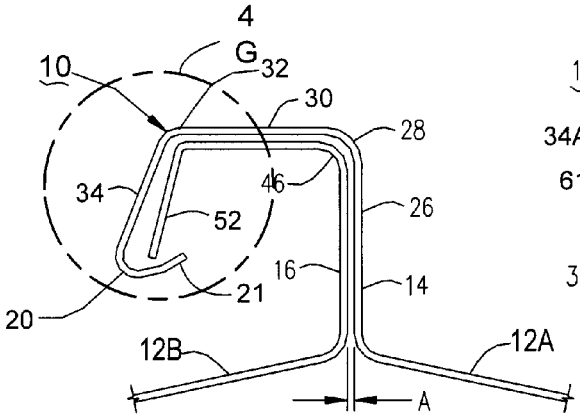

The female sidelap portion 14 has a substantially vertical, or angularly, positioned leg that is formed into a hook 20 at its distal end (edge) for engagement of the male sidelap 16 as the two adjacent roof panels 12A, 12B are joined. In FIG. 4A the interlocked sidelaps 14, 16 are depicted in a field placement pre-seamed condition, and once the panels 12A, 12B are in this position, a seaming machine can be used to mechanical form the sidelaps 14, 16 into the final profile shape of the standing seam 10.

FIGS. 4D-4F show an attachment clip 24 gripped between the sidelaps 14, 16 for connecting the seam 10 to underlying building support structurals. A spatial gap, designated by the dimension "A" in FIGS. 4A-4D, is preferably provided between the upright female and male first legs to permit spatial insertion of the attachment clips, and while this gap is required only at clip locations, it may generally be maintained along the length of the interlocked sidelaps.

Figure 5:
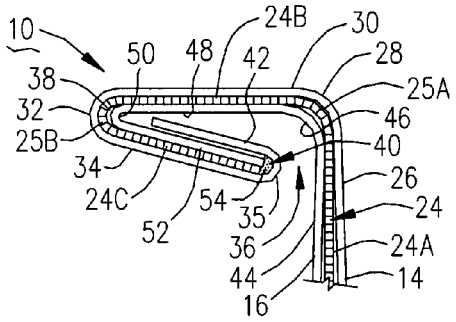
FIG. 5 is an elevational, cross-sectional view of the standing seam of FIG. 4A following one version of mechanically seaming, the view being at a location at which a clip is attached to the standing seam.

The clips 24 are positioned at spaced apart intervals along the standing seam 10, with the tabs (the upper portions of the clips 24) sandwiched between the female and male sidelaps 14, 16. In FIG. 5, the tab of the clips 24 have been field seamed with the sidelaps 14, 16 to create the final profile shape of the standing seam 10. It will be understood that each roof clip 24 has a lower base portion (not shown) beneath the roof panels 12A, 12B that is connected to the building support structure. For purposes of clarity, the clip 24 shown is cross-hatched to aide the reader to more readily distinguish its profile as its tab is layered between the female, male sidelaps 14, 16.

The female side lap 14 has a female first leg 26, a female first radius portion 28, a female second leg 30, a female second radius portion 32, a female third leg 34, and the hook portion 20. These together form a female first cavity 36 (sometimes herein referred to as the first male insertion cavity 36), and a female second cavity 38 (sometimes herein referred to as the second male insertion cavity 38). The male side lap 16 is inserted into these first and second male insertion cavities 36, 38.

A female retaining groove 40 is formed at the distal end of the female third leg 34 in the hook 20 extending from the female third leg 34 and nested within the hook portion 20 of the female sidelap 14.

The male side lap 16 has a male first leg 44, a male first radius portion 46, a male second leg 48, a male second radius portion 50 and a male third leg 52 (sometimes herein referred to as the male tab member 52). The male second radius portion 50 is positioned in the female second cavity 38, and a distal (outer) end (or edge) of the male tab member 52 is positioned in the female retaining groove 40. Mastic 54 is placed in the depth of the female retaining groove 40 to seal the standing seam 10 against moisture migration between the female and male sidelaps 14, 16.

Each clip 24 is seamed with the panel sidelaps 14, 16 so that upward, downward and shear loads are transferred from the panels 12A, 12B into the clips 24 to pass to the building support structure. Each clip 24 is configured to grip both the male second leg 48 and the male tab member 52 when the roof panels 12A, 12B are subjected to either downward or upward loading.

The clip 24 has a clip first leg 24A; a clip second leg 24B; and a clip third leg 24C (sometimes referred to herein as the clip tab 24C). The clip 24 also has a clip first radius portion 25A and a clip second radius portion 25B (and in FIG. 5B, to be described below, a clip third radius portion 25C for the standing seam 10B). For clarity of presentation, the numerical designation of the roof clips in the appended drawings will all be designated by the number 24, though there are some variations in the geometrical configurations thereof and are cross-hatched to facilitate distinguishing the clips among the assembled components.

In FIG. 5, the clip radius portion 25A is shaped to conform to the curvature of the female first radius portion 28 and the male first radius portion 46. The clip second radius portion 25B lockingly engages the male second radius portion 50 in the female second cavity 38, the clip 24 thereby connecting the male side lap 16 to the underlying building support structure by means of its base portion (not shown). The clip tab 24C, the distal end of the clip 24, is lockingly engaged in the female retaining groove 40 formed in the hook 20.

In the installed mode of the standing seam 10 following field seaming, as depicted in FIG. 5, the standing seam 10 has a multiple lock integrity; that is, the standing seam 10 is formed by the interlocking engagement of the female and male side laps 14, 16 and is secured by the male first radius portion 46 in the female first radius portion 28; the male second radius portion 50 in the female second radius portion 32; and the male tab member 52 in interlocking engagement with the female retaining groove 40.

In addition to the aforementioned locking engagement, the male tab member 52 acts as a locking tab that engages the female retaining groove 40 to resist unfurling, or unzipping, by uplift forces. When the panels 12A, 12B are subjected to uplift forces, such as by wind, pivoting disengagement is attempted by the separation by these members, and as this occurs, the male tab member 52 and the female retaining groove 40 permit some upward flexing of the adjacent roof panels 12A, 12B, while maintaining the latching integrity of the side lap portions 14, 16 and closure of the standing seam 10.

It should be noted that, as shown in FIG. 5, the hook 20 wraps around and secures the male tab member 52 and the clip tab 24C to hold on to the standing seam 10, enabling it to resist increased live, shear and rotational loads.

In FIG. 4A, the interlocked adjacent roof panels 12 forming the standing seam 10 are shown in an unseamed field placed condition; once the panel sidelaps are inter-joined as depicted, mechanical seaming will mold them into their final field seamed, geometrical relationship. To obtain a tight seam, it is desirable to form hook 20 prior to other seaming.

This can be accomplished in a factory forming roll process if adequate roll material edge placement in the roll former can be obtained and maintained, or accomplished on the field site, so long as the field-seamer is configured to accommodate the particular shape of the seam hook; however it is usually simpler to achieve the proper final shape if field reforming of hook 20 can be avoided.

Figure 4B:
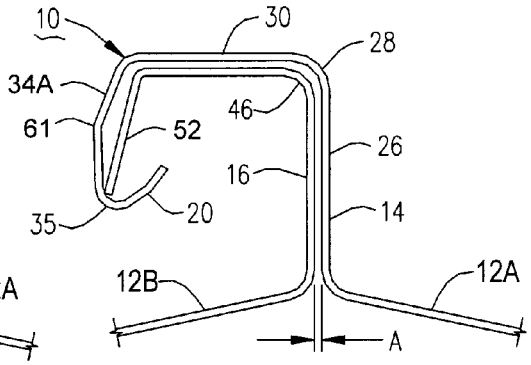

More complete seams are shown in FIGS. 4B and 4C between clips, and FIGS. 4E and 4F where clips are present, wherein the standing seam 10 is gripped by the clip 24 containing a mechanism that enables the standing seam 10 to resist not only unfurling as a result of uplift load as it tends to occur, but also gravity, shear and rotation forces applied to the standing seam 10.

In FIGS. 4B, 4C, 4E and 4F, the hook 20 wraps around and secures the male tab member 52 and the clip third leg 24C to hold the standing seam 10 to enable it to resist increased live, shear and rotational loads.

As discussed herein, it is preferable that the hook 20, during factory forming, be angled such that its distal hook end 21 extends substantially parallel to the leg 34 generally as depicted in FIGS. 4B, 4C, 4F and 4G. However, if the hook end 21 is formed parallel to the leg 34, the length of the hook end 21 needs to be controlled carefully, which is difficult to do for the reason that, in practice, metal coil manufacturers often fail to achieve product within the specified width dimensional tolerance. As will be discussed herein below, the length of the hook end 21 can vary as indicated by the broken line end of the hook end 21 in FIG. 4G. The length of the hook end 21 can be established while achieving the desired angled configuration by placing or removing shims in the factory forming roll tool as required.

The profile of standing seam assembly 10 provides for ease of initially assembling and interlocking the male sidelap 16 with the female sidelap 14, as the female sidelap 14 can be positioned above and dropped or rolled onto the male sidelap 16 to position the sidelaps 14, 16 together as depicted in FIG. 4A. In practice, the panel 12 is formed by a roll forming machine having a series of spaced-apart arbors, each of which supports a series of profiled forming rollers spaced at intervals along the arbors, the rollers on the top arbor and those on the lower arbor established by the roll forming machine to pressure form the panels from sheet material fed to the machine from coil stock.

As mentioned, one edge of the uncoiling material being passed through the roll forming machine will be selected to accommodate the material "run-out." Since the width of the coiled sheet material will of course vary within set tolerance limits, as the coiled material is formed by the forming rollers one edge is maintained at a set datum line while the material's opposing edge will not be fixed; rather, the opposing edge will float, or run-out. Accordingly it follows that this dimensional run-out will case the hook 20 on the female sidelap 14 to vary in dimensional length.

The length and configurations of the hook end portion 21 of the female sidelap 14 is critical in field assembly seaming, affecting load and water tightness performances of the standing seam, because if the hook 20 is improperly formed, the panel seam will not seam and perform correctly. One means of insuring the hook 20 folds into the cavity properly as the final stages of field seaming forms the correct configuration is to form the hook end 21 substantially parallel to the male third leg 52 before folding the female third leg 34, clip third leg 46C and the male third leg 52 into the male cavity 36. One problem is the width tolerance of the raw material coil used to roll form the panel is difficult to control, coil manufacturers often allow coil width to exceed the desired or specified width.

Figure 10:
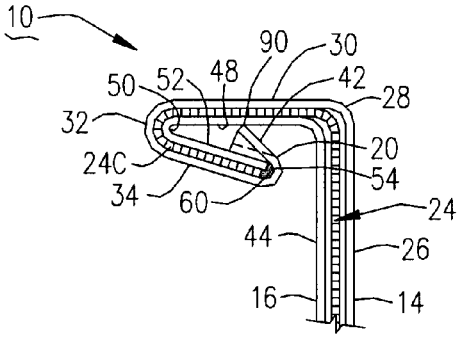
FIG. 10 is an end view of a portion of the standing seam assembly of FIG. 5, showing the scalloping condition of FIG. 9.

To accommodate this extra width the hook 20 may be angled outward from leg 34 and made long enough to accommodate excess coil width and form an effective hook, but this can result in the hook end 21 being so long that it prevents proper forming of the finished standing seam. A second problem is that the resultant angle of hook 20 relative to female leg 34 of the female sidelap portion 14 can cause difficulties in field seaming the sidelap. When the field seaming process is performed, forming the panel as shown in FIG. 10 (described further below), the distal end 21 of hook 20 can come into contact with the underside of male second leg 48, preventing fully closing of the seam. This can prevent proper forming of the final seam profile, resulting in premature up-loading failure. In order to overcome this problem and obtain a tight seam, it is sometimes necessary to pre-form hook 20 into the profile shown in FIG. 4A by pre-seaming operation.

The proper shape and length of the hook 20 required to place it in position for proper field assembly and seaming can be achieved in a number of ways. Proper hook shape and length may be obtained by:

1) by forming the hook at a wide angle, thus accommodating a wide coil, and then reforming the hook after seam assembly and before final seaming; (However, in this situation, it will be noted that leg 34 of the female sidelap portion 14 and male tab portion 52 of male sidelap 16 are close to being parallel to each other, but hook 20 is generally inclined at an angle from leg 34 of the female sidelap portion 14. Since the length of hook 20 varies to accommodate variable material widths used in the formation of the panel 12 and thus the female sidelap 14, by having the hook at an angle from leg 34 of the female sidelap portion 14 a greater width range of panel material can be accommodated than if the hook 20 were formed parallel to leg 34. But, if the panel width is excessive, it can prevent field placement of the female sidelap over the male sidelap 16.)

2) by controlling the width of the coil and forming the hook 20 to the proper shape and length before field assembly of the seam;

3) by developing tooling with an adjustable spacer in the shaft between the main roll form tools, the variance in coil width can be controlled so that proper material edge placement is attained and maintained so that the length of the hook 20 is kept within acceptable limits, assuring that the material forming the hook 20 runs out properly and accommodates any scalloping (described below with reference to FIGS. 9-10), yet is long enough to achieve proper seam performance; or 4) by crimping or bending the normally straight female third leg 34 into an angled leg as depicted in FIGS. 4B-4F (and FIGS. 45 through 46A discussed below), thereby causing the hook 20 to assume a disposition more nearly parallel to the male third leg 52 (it should be noted that crimping the female third leg 34 has an additional benefit of tightening the grip of the crimped female third leg 34 around the male third leg 52 and the clip 24 along the length of the standing seam).

As discussed above, the female third leg 34 of the female sidelap portion 14 and the tab portion 52 of the male sidelap 16 are close to being parallel to each other, but the hook end 21 may not be parallel. The hook end 21 may be inclined at an angle to accommodate variations in the width of raw material used to form the female sidelap 14, and if the width of the panel is excessive, the length of hook end 21 is extended, causing the hook end 21 to contact the under side of the male sidelap 16 during seaming, thereby likely preventing proper field assembly. If the hook end 21 is formed at an improper angle, or if it is too long, the hook end 21 can prevent proper forming of the final seam profile, resulting in premature uploading failure.

In order to overcome the problem of improper hook formation and obtain a tight seam, it is sometimes necessary to pre-form the hook 20 into the proper profile by pre-seaming after initial panel positioning. This can be accomplished during factory forming if adequate roll adjustment and material edge placement in the roll former can be obtained and maintained. It can also be accomplished at an installation site by a field seamer having appropriate capability to properly form the hook prior to final seaming.

Mention should now be made of a phenomenon referred to as scalloping, an effect depicted in, and described further with reference to, FIGS. 9 and 10 below. Such scalloping can exacerbate the criticality of the run-out length of the hook 20.

In sum, the control of the length and angular disposition of the hook 20 is important for field seaming, not only to avoid unnecessary mechanical interference, and assembly, but also as it affects load capacity and watertightness of the panel sidelaps. Good practice will form the hook 20 at an angle sufficient to accommodate coil width tolerances, while assuring that the length of the hook is not so excessive as to interfere with the field seaming required to achieve acceptable loading capacity and weather tightness performances of the finally formed standing seam. In fact, if the length of hook 20 is not controlled by limiting raw material tolerances or by varying shims, and the hook 20 is too long, proper forming of the finished sidelap will probably not be achieved.

Figure 45:
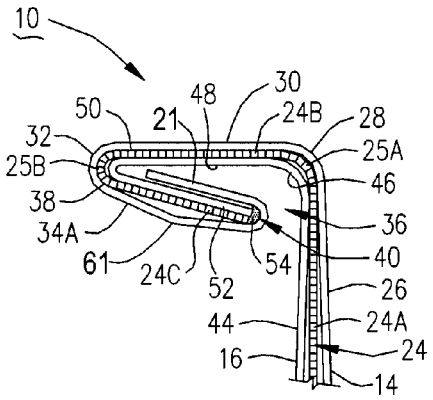
FIG. 45 is an elevational end view of a modified embodiment of the standing seam of FIG. 2.
Figure 46:
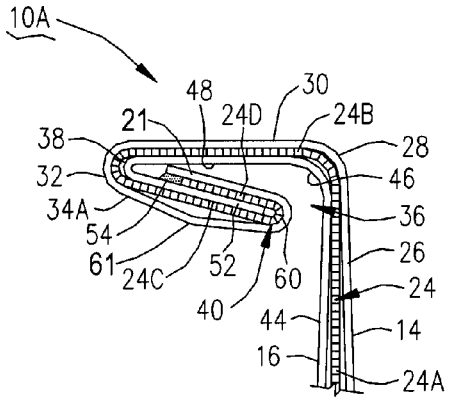
FIG. 46 is an elevational end view of a modified embodiment of the standing seam of FIG. 4.
Figure 46A:
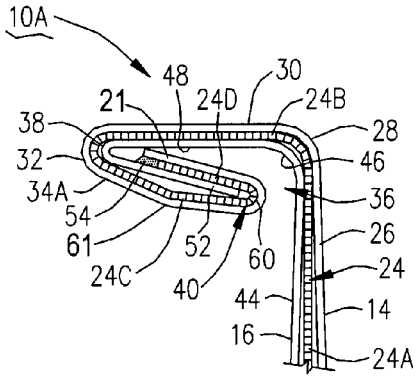
FIG. 46A is an elevational end view of a modified embodiment of the standing seam of FIG. 46.
Figure 47:
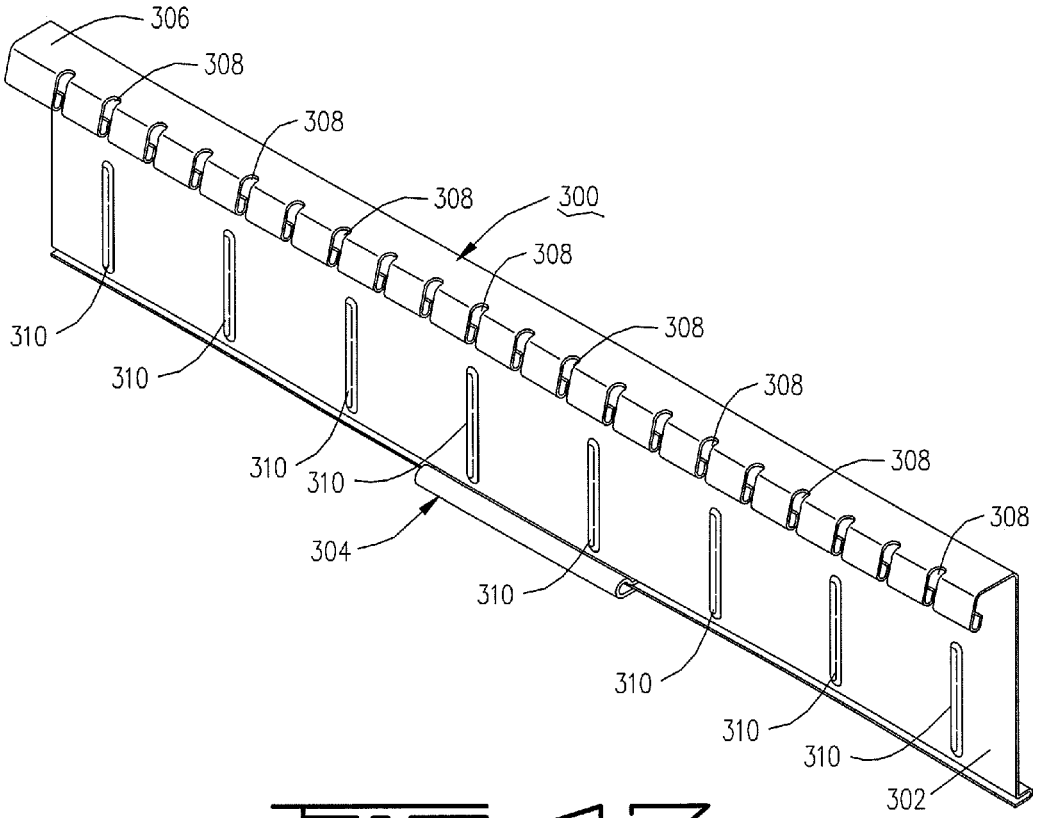
FIG. 47 is a perspective view of an elongated roof panel clip and strengthening beam.

Having above described the particulars of the standing seam 10 as depicted in FIGS. 4A-4F, attention will now be directed to the modification of the female third leg 34A. Instead of this portion of the female sidelap 14 being straight as previously described with reference to FIGS. 4A and 4D, it will be noted that the female third leg 34A is crimp formed as shown in FIGS. 45-46A (discussed below) to have an angled bend apex at point 61. This crimped female third leg 34A of the female sidelap 14, when flexed by wind uplift, serves as a back wound, flexed spring to resist unfurling of the standing seam 10, enhancing the multiple lock integrity of the seam not only under uplift loading, but also under gravity, shear and rotation forces.

FIGS. 4E and 4F show the standing seam 10 in which the edge of the male tab 52 is disposed in the clip retaining groove 60 of the clip 24. The hook 20 and the clip fourth leg (denoted as 24D in FIG. 4) wrap around and secure the male tab 52 in the hook 20, reinforcing and securing the end, or edge, of the clip 24.

As with the above described standing seam 10 of FIGS. 4B and 4E, the female third leg 34, crimp formed at angled bend apex 61, is bowed away from the clip third leg 24C and the male tab 52 of the male sidelap 16. If this crimp is set in the factory, at the jobsite following initial coupling of the female and male sidelaps 14, 16, the field seamer will apply inward force to the crimped female third leg 34, reducing the acuteness of the crimp angle while simultaneously applying inward pressure to the third clip leg 24C and the male tab 52. As this occurs, the clip leg 24C and male tab 52 are caused to be inserted further into the female retaining groove 40; then as the seaming operation releases the inward pressure and the crimp, or angled bend, 61 loses some of its included angle, the hook end 21 will assume a more vertical orientation, and the female retaining groove 40 is closed on clip third leg 24C and male tab 52, thereby resulting in a tighter seam, enhancing resistance to seam unfurling and to failure under uplift, gravity, shear and rotational loads.

The crimped female third leg 34, when flexed inwardly in the seaming operation, allows the distal ends of the male tab 52 and the clip third leg 24C to be extended further into the female retaining groove 40; then, as the seaming operation releases the inward pressure on angled bend 61, the female third leg 34 tends to return to its original shape, bringing the female cavity closer to the distal ends of the included members, such as the male tab 52 and/or the clip third leg 24C, increasing the resistance to unfurling and failure.

The crimp 61, accomplished by factory forming or field formed at the jobsite, will serve to locate where the seaming break is to be located and reduces the field seaming force required to further form it. Furthermore, as the included angle at 61 increases there will be a tendency for the hook 20 to rotate counterclockwise (as viewed), making it easier to close the included angle of hook 20. As the angle of the break at crimp 61 is increased, there will be a tendency for the hook 20 to close and to be forced against the distal end of the clip 24, or in the spacings between the clips 24 and the distal end of the male third leg 52. If sufficient seaming pressure is applied, the clip third leg 24C and the female third leg 34A will also be deformed, thereby further tightening the seam 10.

FIGS. 5A-5B

Figure 5A:
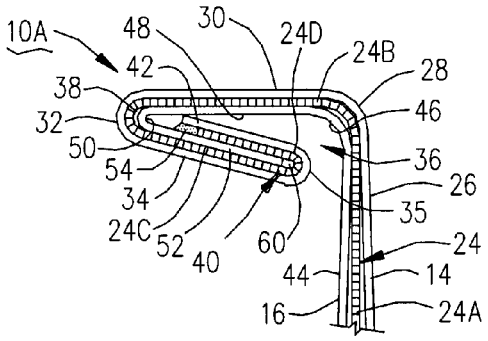
FIG. 5A is an elevational, cross-sectional view of a portion of the standing seam assembly of FIG. 5 showing an alternative configuration of the male sidelap portion and the retaining clip.

FIG. 5A shows a standing seam 10A in which, like the standing seam 10, the female second leg 30 extends substantially perpendicularly to the female first leg 26 in the female sidelap 14. Here, however, the clip 24 is formed to have a clip retaining groove 60 in which the end of the male tab 52 of male side lap 16 is positioned, and in turn, the radius portion of the clip 24 that forms clip retaining groove 60 and the clip retaining groove 60 itself are positioned in the female retaining groove 40 of the female side lap 14.

In this embodiment, the clip 24 has a clip fourth leg 24D, and the hook end 21 is positioned adjacent to the end of the clip fourth leg 24D; mastic 54 is placed as shown to seal the ends of the female side lap 14 and the male tab member 52 (in addition to, or in lieu of, mastic in the clip retaining groove 60).

In FIG. 5A, both the hook 20 and the clip fourth leg 24D wrap around and secure the male tab 52. Further, the hook 20 wraps around, reinforces and secures the clip fourth leg 24D to hold the standing seam 10A to the building support structure (by the base portion of clip 24, which is not shown), thus providing increased resistance to uplift, gravity, shear and rotational loads.

The clip hook 24 serves an important feature in that one of the failure modes of a standing seam roof under uplift failure conditions is that the clip tab which counters roof uplift load is in tension and sometimes tends to deform (straighten out) to pull out from between the male and female sidelaps. The clip hook, which is usually formed of stronger metal than the panel sidelap, is wrapped around the male sidelap end (or edge) and provides a much more secure lock, especially when the tab is lengthened as described herein and wherein the female sidelap wraps around the clip to further restrain the clip fourth leg 24D. Furthermore, as the second male leg 48 begins to unfurl, it exerts pressure on the hook 20 to restrain both the clip fourth leg 24D and the hook 20.

Figure 5B:
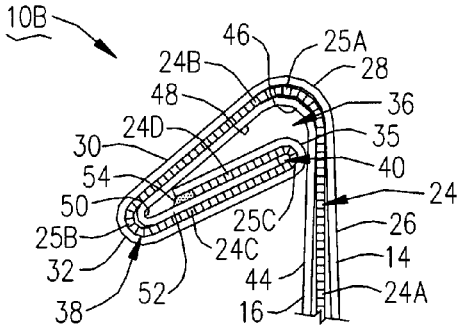
FIG. 5B is an elevational view of an alternative embodiment of the standing seam assembly of FIG. 5, in which the clip tab is hooked over the distal edge of the male sidelap.

FIG. 5B shows another standing seam 10B wherein the standing seam of FIG. 5 has been further seamed, that is, the seam is over-bent, rotating the seam to extend angularly toward the male roof panel 12B to create an acute angle with respect to the female first leg 26, which extends substantially normal to the female roof panel 12A. The standing seam 10B provides a tighter and stronger, more watertight seam, because the over-bending of the female and male sidelaps 14, 16, along with the clip 24, requires a longer arc length for the female first radius portion 28. That is, the over-bending of the standing seam 10B causes the female radius portions 28, 32 to be pulled more tightly against clip radius portions 25A, 25B; and the over-bending of the clip radius portions 25A, 25B draws them more tightly against the male radius portions 46, 50C. This, in turn, is believed to draw the hook 20 more tightly against the radius of the clip third leg 25C because of material slippage between the female sidelap 14 and the clip 24.

With regard to the standing seam 10B depicted in FIG. 5B, over bending during seaming really pulls the female radii 28, 32 more tightly against clip radii 25A, 25B, and the over bending of the two clip radii draws them more tightly against the male radii 50C and 46, which in turn draws the female retaining groove 40 of the female sidelap 14 more tightly against clip retaining groove 60 of the clip 24 because of material slippage between the female and clip.

FIGS. 6-7

Figure 6A:
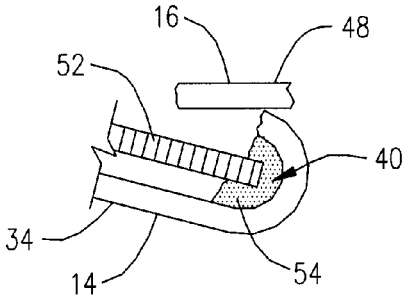
FIG. 6A is a detail view of a portion of the standing seam assembly of FIG. 6.
Figure 6:
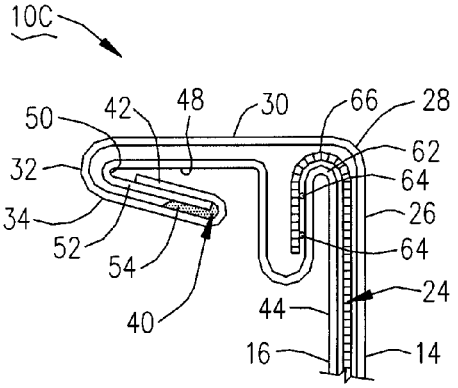
FIG. 6 is an elevational view of an alternative standing seam assembly between adjacent panels in the final formed configuration to resist in plane shear movement.

FIG. 6 shows a standing seam 10C wherein the tab of the clip 24 is shaped to form a hook 60 that grips the male sidelap 16 over a radius portion 62 formed in the male second leg 48. This strengthens the standing seam 10C for uplift and diaphragm loads, that is, shear loads in the plane of the roof between panels. Also, this arrangement separates the clip 24 from the seamed portion so that the clip 24 avoids the mastic 54 and is not inserted in the sealingly engaged edges of the female sidelap 14 and the male sidelap 16. The clip 24 can be provided a number of serrated teeth 64 to improve the gripping action on both the male sidelap 16 and female sidelap 14 to increase resistance to in-plane panel sidelap shear and relative movement between adjacent panels.

The clip 24 as configured in FIG. 6 provides several advantages. Namely, the clip 24 is simple to manufacture and can be made from heavy, stiff material to provide diaphragm strength between panels.

The standing seam 10C separates the engagement of the clip 24 from the edges of the male sidelap 16 and the female sidelap 14 that are sealed by the mastic material 54. This separation provides for transfer of uplift forces from the clip 24 into the male seam as depicted in FIG. 6A, wherein the male tab 52 has its proximal end (or edge) disposed in the mastic material 54 in the female retaining groove 40, both of which move together in unison as the roof panels 14, 16 expand and contract in relation to the clip 24.

All of the standing seams discussed above have the female sidelap 14 which forms the female retaining groove 40 that lockingly engages the male tab 52 of the male sidelap 16. This engagement drives the male tab 52 into ever more pressing engagement with the retaining groove 40 as uplift forces tend to separate the female first leg 26 of the female sidelap 14 from the male first leg 44 of the male sidelap 16. The locking characteristic of this seam is not limited to seams having female sidelaps which form the female retaining groove 40, for an equivalent embodiment would be to have the male sidelap 16 form the retaining groove 70, as shown in FIG. 7.

FIG. 7 shows a standing seam 10D wherein the male sidelap 16 has a male first leg 44; a male first radius portion 46; a male second leg portion 48; a male second radius portion 50; and a male third leg, or male tab, 52. The male second leg 48 and the male third leg 52 form a male retaining groove 70 at the male second radius portion 50.

In the standing seam 10D, the female sidelap 14 has the female first leg portion 26, the female first radius portion 28, the female second leg portion 30, the female second radius portion 32, the female third leg portion 34, the female third radius portion 72, and the female fourth leg portion 74; the female fourth leg portion 74 also is referred to herein as the female tab member 74. The mastic material 54 is appropriately disposed to sealingly engage the ends (or edges) of the female sidelap 14 and the male sidelap 16, and the clip 24 is formed to have the clip fourth leg 24D that wraps around the male tab 52 for locking engagement therewith.

In the seamed configuration depicted in FIG. 7, the female tab member 74 has an end portion disposed in the male retaining groove 70 of the male sidelap 16. Uplift forces that tend to separate the male first leg portion 44 (male sidelap 16) from the female first leg portion 26 (female sidelap 14) will drive the female tab member 74 into ever more pressing engagement with the male retaining groove 70, thereby resisting the unfurling or unzipping of the standing seam 10D.

It should be noted that sealant 54 can be moved into male retaining groove 70 and clip fourth leg 24D extended to lock in the male retaining groove 70, thus increasing the resistance of failure at a clip location.

FIGS. 8-12

Having discussed the configuration of the characteristic locking engagement of the tab members and the retaining grooves of the several standing seam embodiments, the reader's attention will now be directed to the method of field seaming the standing seam and of attaching the standing seam to the underlying building support structure.

FIG. 8 shows the standing seam 10 of FIG. 2 in its snapped together but unseamed condition. During assembly, the clip 24 is placed over the male sidelap 16, and the female sidelap 14 is then placed over both. In this manner, the hook 20 of the female sidelap 14 is positioned there below. The mastic material 54 is supported within the female sidelap 14 before field seaming.

The clip 24 as shown in FIG. 8 is one type of clip typically used and is of two-piece construction, having an attachment end 80 with apertures 82 through which fasteners 84 extend and are attached in threading engagement with the underlying building support structure 86, such as in the attachment of the clip 24 to a panel support assembly 86 (or directly to a bar joist). A large washer 81 can be positioned under the head of the fastener 84 for added load transfer. The clip 24 has a support shelf 88 for supporting the male sidelap 16 during the assembly and seaming of the standing seam 10. Further, the upstanding clip first leg 24A supports the edge of the male tab member 52 when subjected to uplift loading.

In the seaming operation, it is necessary to prevent the edge of the hook 20 of the female sidelap 14 from distorting in a manner that creates a scalloped edge, such as depicted in FIGS. 9 and 10. A scallop, such as depicted, increases the effective width of the seamed joint, and when this occurs, if the scallop is too wide, it will interfere with the forming of the desired included angle of the female second radius portion 32 because the scalloped edge of the hook end 21 will make contact with, or jam against, the male second leg 48 of male sidelap 16, as depicted in FIG. 10 at point 90.

Figure 11:
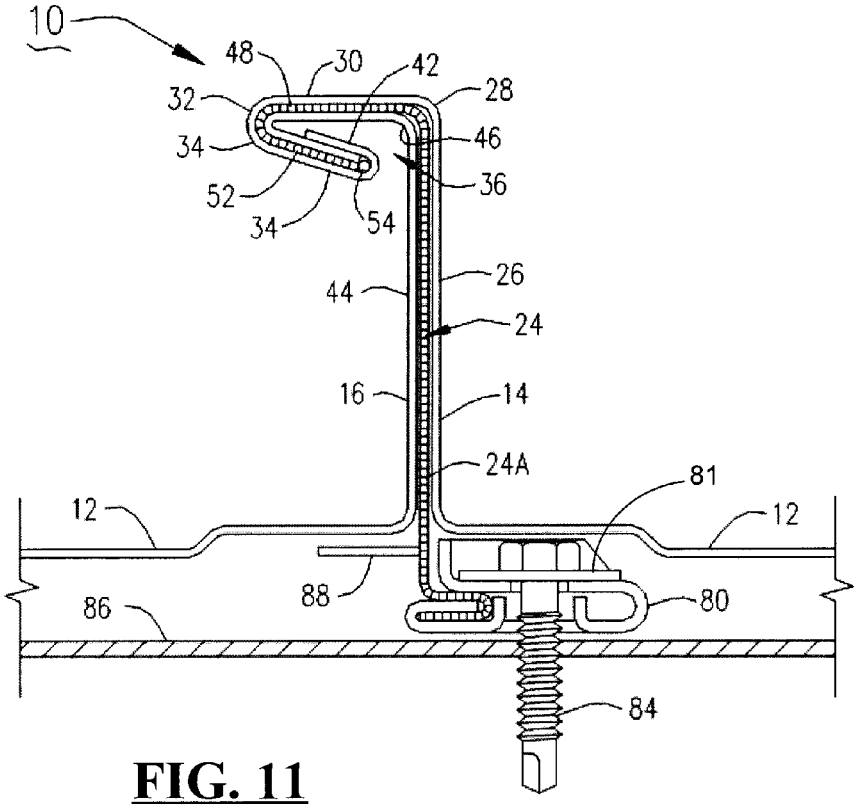
FIG. 11 is an elevational view of a standing seam assembly of FIG. 5 after field forming and attachment to the underlying support structure using an oversized washer.

It is possible to pre-form the hook 20 or to crimp the hook 20 against the male tab member 52 before forming the desired included angle within the female second radius portion 32. While FIG. 11 shows the standing seam 10 in a typical final seamed position (other seam positions are also possible) as attached to the underlying panel support assembly 86, it will be understood that the angular disposition of the legs 26, 30, 34, 42 (of the female sidelap 14), the legs 48 and the male tab 52 (of the male sidelap 16) and the corresponding legs of the clip 24 can be angularly formed during the seaming process as desired and can be angularly disposed downwardly as that depicted in FIGS. 5 and 5A, it being noted that the greater the downward disposition of the seam, the tighter, stronger and more watertight it becomes.

Figure 12:
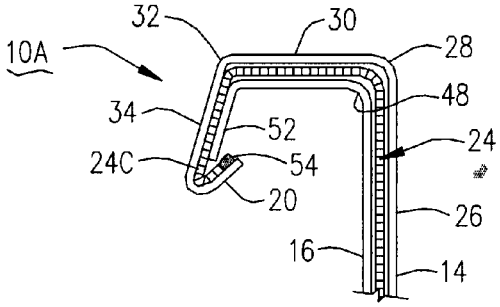
FIG. 12 is an elevational view of the standing seam assembly of FIG. 4 before the field seaming operation is performed.

Similarly, FIG. 12 shows the standing seam 10A (FIG. 4) in its snapped together but unseamed condition, whereby both the hook 20 of the female sidelap 14 and the edge of the clip 24C has deflectingly passed the male tab 52 of the male sidelap 16 in order to be wrapped around the male tab 52 during the seaming.

FIGS. 13-20

Figure 13:
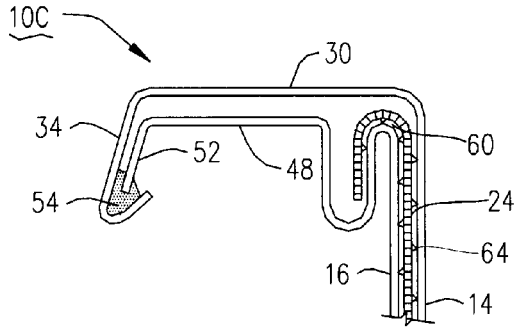
FIG. 13 is an elevational view of the standing seam assembly of FIG. 6 before the field seaming operation is performed.
Figure 14:
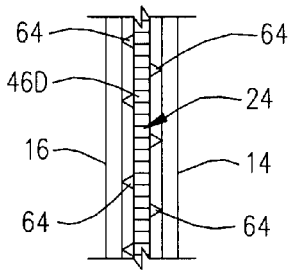
FIG. 14 is an enlarged portion of the standing seam assembly of FIG. 13.

FIG. 13 similarly shows the standing seam 10C (FIG. 6) in its unseamed mode with the serrations 64 relocated, as shown in FIG. 14, wherein the clip tab 24 has the serrations 64 engaging both male sidelap 16 and female sidelap 14 to prevent relative in-plane movement between the two.

Figure 15:
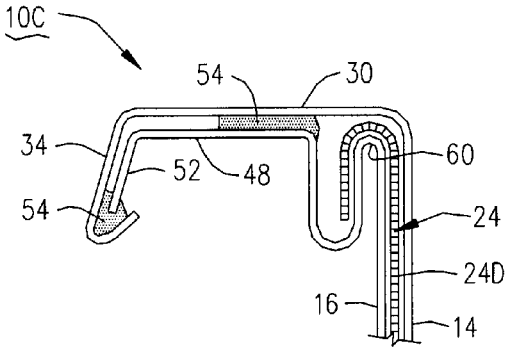
FIG. 15 is an elevational view of an alternative embodiment of the seam of FIG. 6 prior to being field seamed.

FIG. 15 shows a modification to the standing seam 10C of FIG. 13, wherein the mastic sealant 54 is provided in two locations, both at the distal ends where the female sidelap 14 and the male sidelap 16 are crimped together, and between the female second leg 30 and the male second leg 48.

Figure 16:
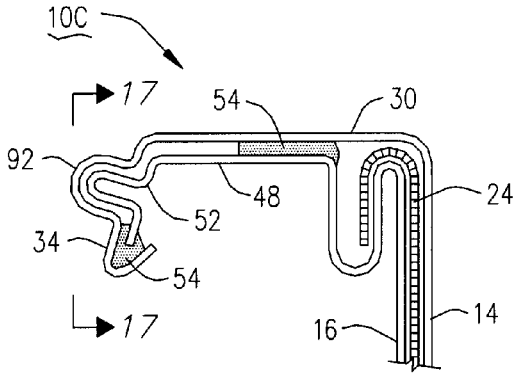
FIG. 16 is an elevational end view of an alternative embodiment of the standing seam assembly of FIG. 15 wherein the female sidelap portion and the male sidelap portions are staked together.
Figure 17:
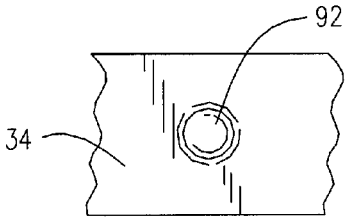
FIG. 17 is an elevational side view of a staking location of the standing seam of FIG. 16.

FIGS. 16 and 17 show further modifications to the standing seam 10C, wherein the female third leg 34 of the female sidelap 14 and the male tab member 52 of the male sidelap 16 are mechanically staked together by an upper crimp 92 to prevent relative in-plane longitudinal shear movement between adjacent panels. FIG. 17 shows an elevational view of the crimp 92 as it appears from outside the standing seam 10 (at 17-17 in FIG. 16). Of course, while the crimp 92 is shown as an outwardly extending crimp, it will be appreciated that an inwardly extending crimp would work equally well.

Figure 18:
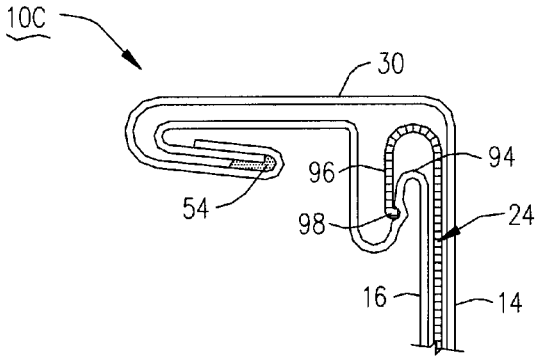
FIG. 18 is yet another alternative embodiment of the seam of FIG. 6.

FIG. 18 shows yet another modification to the standing seam 10C (FIG. 6), wherein the male sidelap 16 forms a wedge 94 that is disposed inside hook 96 of the clip 24. Uplift forces cause the male sidelap 16 to rise and rotate clockwise and cause the female sidelap 14 to rotate counter-clockwise, thereby forcing the wedge 94 into the cavity of the hook 96. At a selected amount of wedging displacement, a notch 98 is engaged by the leading edge of the hook 96 to mechanically lock, thereby enhancing the lockability and insuring that the clip 24 does not disengage from the male sidelap 16.

Figure 19:
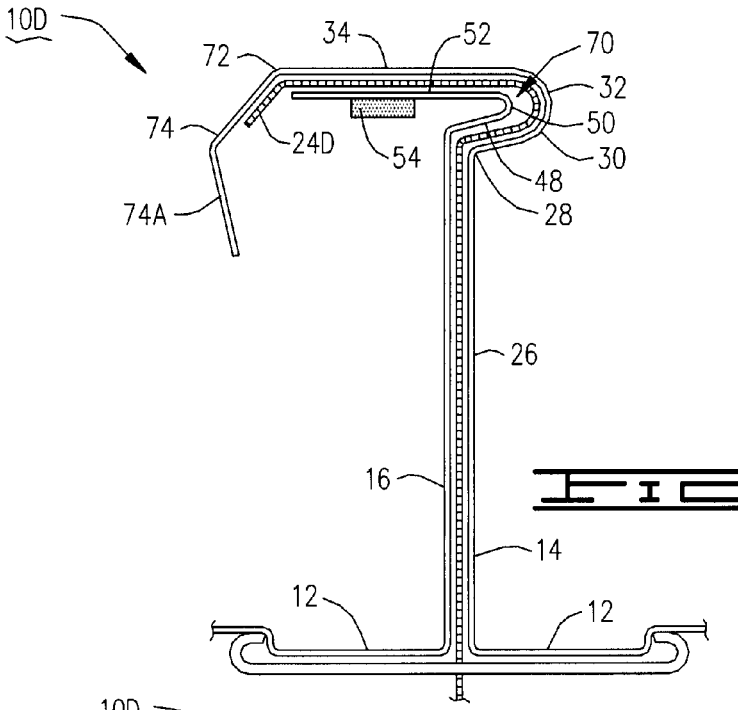
FIG. 19 is an elevational view of the standing seam assembly of FIG. 7 prior to field seaming.
Figure 20:
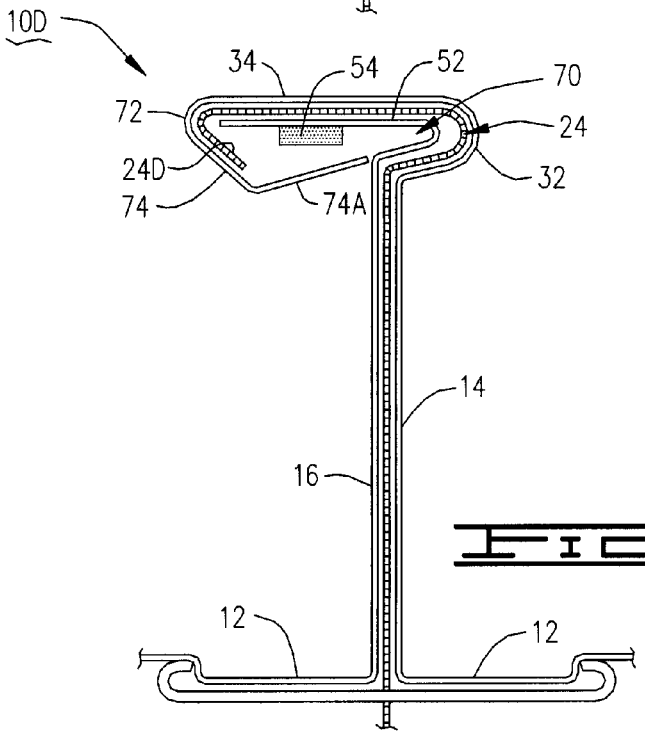
FIG. 20 is an elevational view of the standing seam assembly of FIG. 7 at an intermediate configuration during field seaming.

FIG. 19 shows the standing seam 10D of FIG. 7 in an unseamed, or pre-seamed, mode. The seaming operation rotates the female tab 74A counter-clockwise and urges it and the end 24D of the clip 24 to progressively form around the end of the tab 52 of the male sidelap 16, as shown in FIG. 20, with the end of the female tab 74A engaged in the retaining groove 70 in the final seamed mode, which is depicted in FIG. 7.

Seaming further partially straightens female tab 74A as shown in FIG. 7, thus driving distal end of female tab 74A further into retaining groove 70.

FIGS. 21-24

Figure 21:
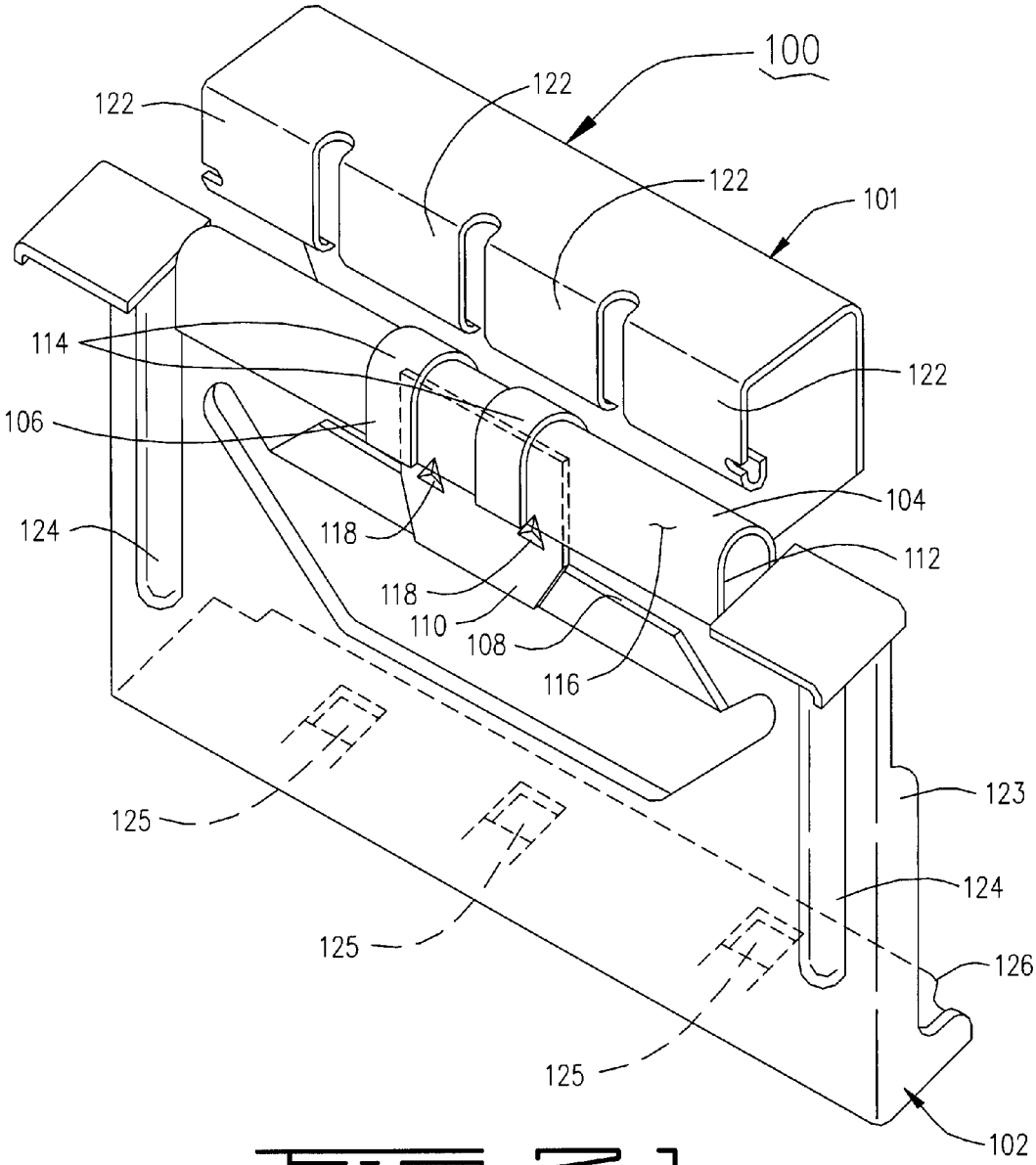
FIG. 21 is an isometric view of a two-piece clip.

FIG. 21 shows an alternative two-piece clip 100, which has a hold down clip tab 101 and a clip base 102 to which the hold down clip 101 is slidingly attached. The clip base 102 has a beam section 104 and an upwardly pointing flange portion 106 having a top flange surface 108. The beam section 104 and flange portion 106 slidingly support the hold down clip tab 101 to limit vertical movement thereof, and to provide for longitudinal movement of the hold down clip tab 101 relative to the clip base 102 along the beam section 104.

More particularly, the hold down clip tab 101 has a first tab member 110 that slidingly engages an inside surface 112 of the beam section 104, and a pair of second tab members 114 that slidingly engage an opposing outer surface 116. A pair of third tab members 118 extend from the first tab member 110 and slidingly engage the top flange surface 108. In this manner, the top flange surface 108 provides a track on which the hold down clip 101 slides in a longitudinal direction.

Figure 21A:
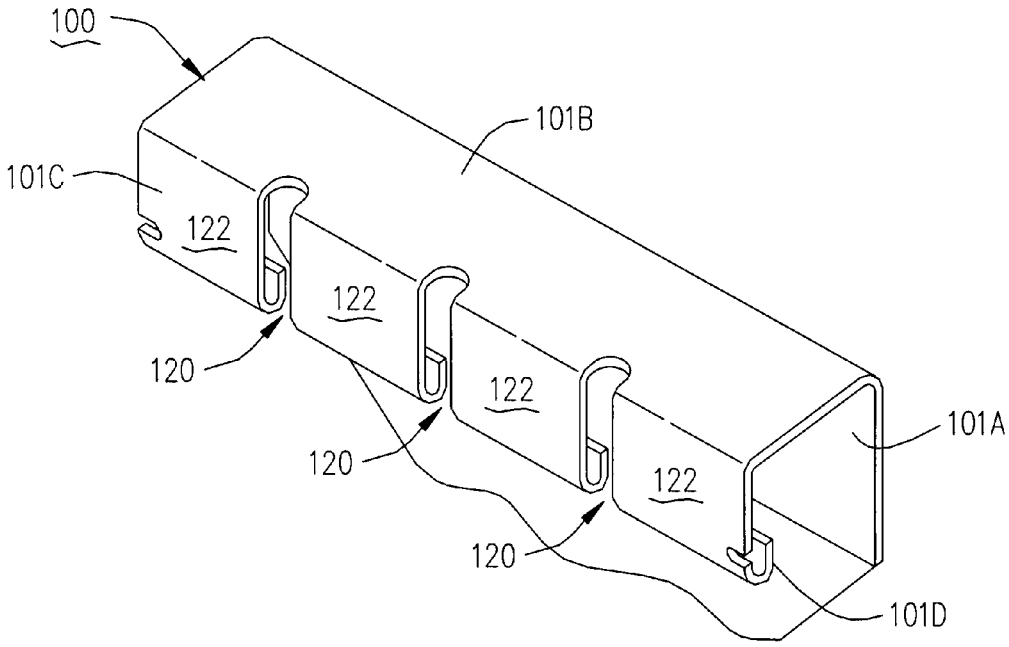
FIG. 21A is an enlarged view of the tab portion of the clip of FIG. 21.
Figure 21B:
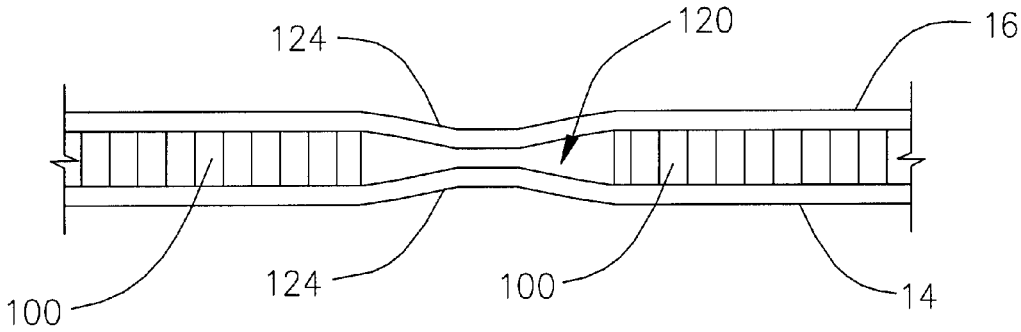
FIG. 21B is an enlarged, partial view of one of the notches of the tab portion following seaming.

FIG. 21A, an enlarged view of the top portion of hold down clip tab 101 of the clip 100, shows that the clip tab 101 is composed of a first clip leg 101A, a second clip leg 101B, a third clip leg 101C and a fourth clip leg 101D, the latter mentioned two legs forming a hook. Notches 120 in the third clip leg 101C form fingers 122 that allow a seamer to fold the fingers 122 without incurring and overcoming the resistance to folding other fingers simultaneously. The notches 120 also allow the seamer to slightly bend portions of the material in the female second radius 32 of standing seam 10 (FIG. 2), or male second radius 50, that are indented into the notches 120 as depicted by 124 in FIG. 21B, thereby binding the clip 100 into the seam to increase its resistance to failure.

During seaming of the standing seam 10 when connected to the underlying support structure by the clip 100, the female seam 14 and the clip 100 are pulled tighter over the male sidelap 16, and collapsing these members occurs into the notches 120 create the indentures 124. As the sidelaps 14, 16 are seamed, it is this tightening and stretching of the female sidelap 14 creating the slight indentures 124 into the notches 120 that add to the locking integrity of the standing seam 10.

Figure 22:
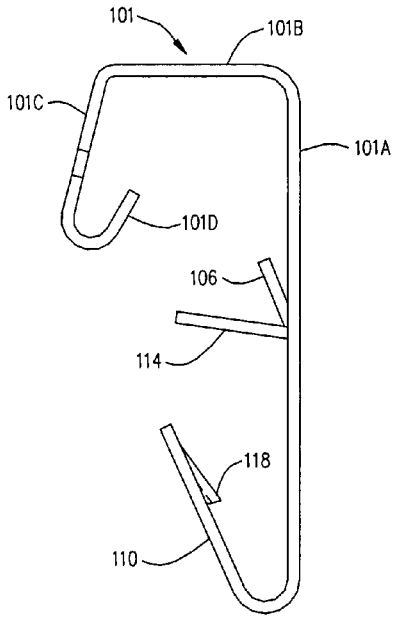
FIG. 22 is an end view of the hold down tab portion of the two-piece clip of FIG. 21.
Figure 23:
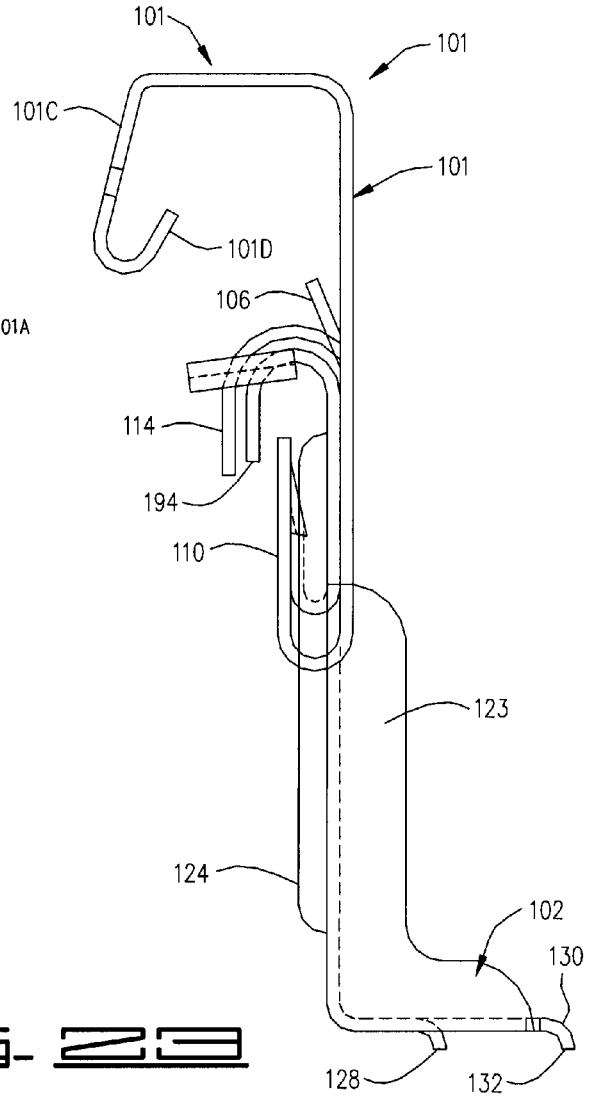
FIG. 23 is an end view of the two-piece clip of FIG. 21.

Modifications to the clip 100 can be as that depicted in FIG. 22, which shows the hold down clip 101 before being installed on the clip base 102, and in FIG. 23, which shows the hold down clip 101 after installation on clip base 102. The installation is accomplished by inserting the first tab member 110 and the second tabs 114 around the beam section 104 of the clip base 102. The first tab member 110 is formed upward and its end placed inside the beam section 104. The second tabs 114 are formed downward to engage the beam section 104 in opposition to the first tab member 110.

Figure 24:
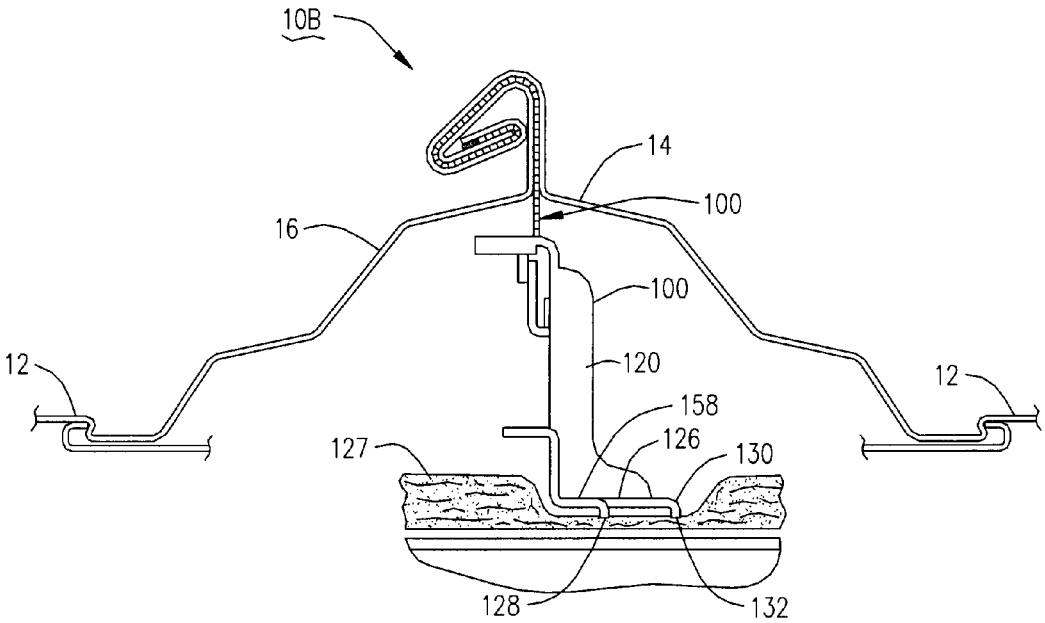
FIG. 24 is an elevational view of one version of the standing seam of FIG. 4 attached to the underlying support structure by the two-piece clip of FIG. 21.

The clip base 102 can be formed from a single piece of sheet metal configured as shown so to include rib sections 123 and embossments 124 to provide additional strength and resistance to distortional forces upon the clip base 102. The clip base 102 is anchored to the underlying support structure, such as a purlin, as depicted in FIG. 24, by conventional fasteners (not shown). More particularly, the fasteners are placed through openings 125 (FIG. 21) in a bottom facing flange 126 of the clip base 102. To provide a solid connection for the base over thermal insulation 127 above the purlin, the flange 126 is formed with feet 128 that extend downwardly at an angle substantially normal to the flange 126 and which thereby easily compress the thermal insulation 127 to bear solidly on the purlin. The feet 120 are formed by punching rectabular holes or openings through the flange 126 and forming the metal of the openings downward. Additionally, a back edge 130 of the flange 126 is formed downwardly to provide a foot 132 that acts in cooperation with the feet 128 to support the flange 126.

Finally, FIG. 24 shows the standing seam 10B (FIG. 5) formed of adjacent panels 12 having trapezoidal sidelap portions and secured to the underlying roof structure with the two-piece clip 100 of FIG. 21. It will be noted that all of the exemplary configurations of the standing seam 10 discussed herein above can be used with trapezoidal sidelap portions, and with either the one-piece clip 24 or the two-piece clip 100. It is noted that there are at least three general stages of panel forming from substantially flat coils to ultimate failure. They are 1) forming of individual panels before assembly; 2) assembly and field seaming; and 3) panel deformation during panel force bearing or loading. Panel deformation during seaming and loading is a critical but usually ignored portion of panel life during loading.

Having discussed the standing seam 10 along with several modifications thereof, and as well, alternative sidelap portion configurations and clip configurations, attention will now be directed to a method of seaming the standing seam 10 during the second stage of forming which usually occurs during field installation of a standing seam roof. As discussed above, the standing seam 10 requires a pre-crimping operation of the hook 20 of the female sidelap 14 prior to jointly forming the male tab member 52 of the male sidelap 16 and the female third leg 34 of the female sidelap 14 to the desired angle at the female first radius portion 28 and female second radius portion 32. This prevents scalloping of the edge of the hook 20 as discussed above and shown in FIG. 9. This pre-crimping may be performed in the factory or the field.

FIGS. 25-32

Figure 25:
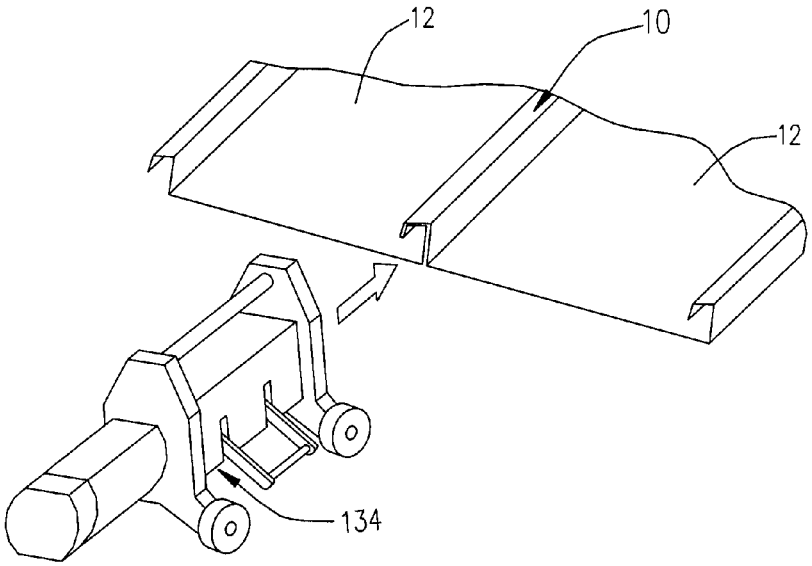
FIG. 25 is a diagrammatic representation of a conventional seaming machine spatially disposed to form a standing seam.
Figure 26:
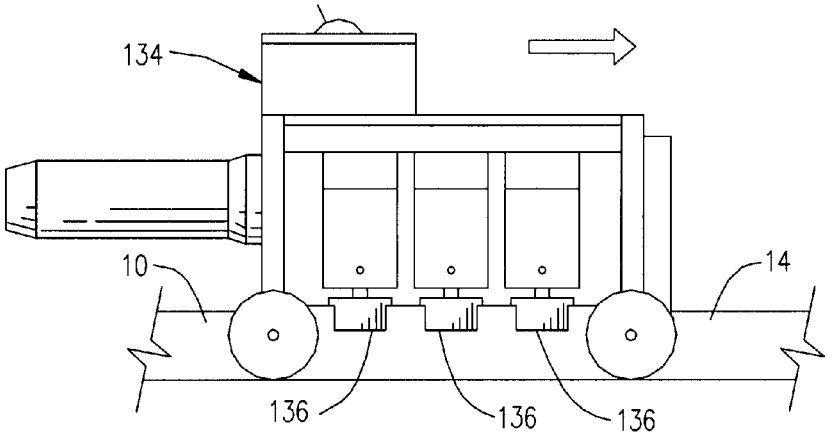
FIG. 26 is an elevational, semi-detailed side view of the seaming machine of FIG. 25.

FIG. 25 depicts a conventional seamer apparatus 134 that is widely used in the art to perform seaming operations on standing seam roofs. FIG. 26 is a side view of the seamer 134, which typically employs a series of roller pairs 136, usually three sets, to progressively form the standing seam 10 with the pre-crimper attached to the front plate.

Figure 27:
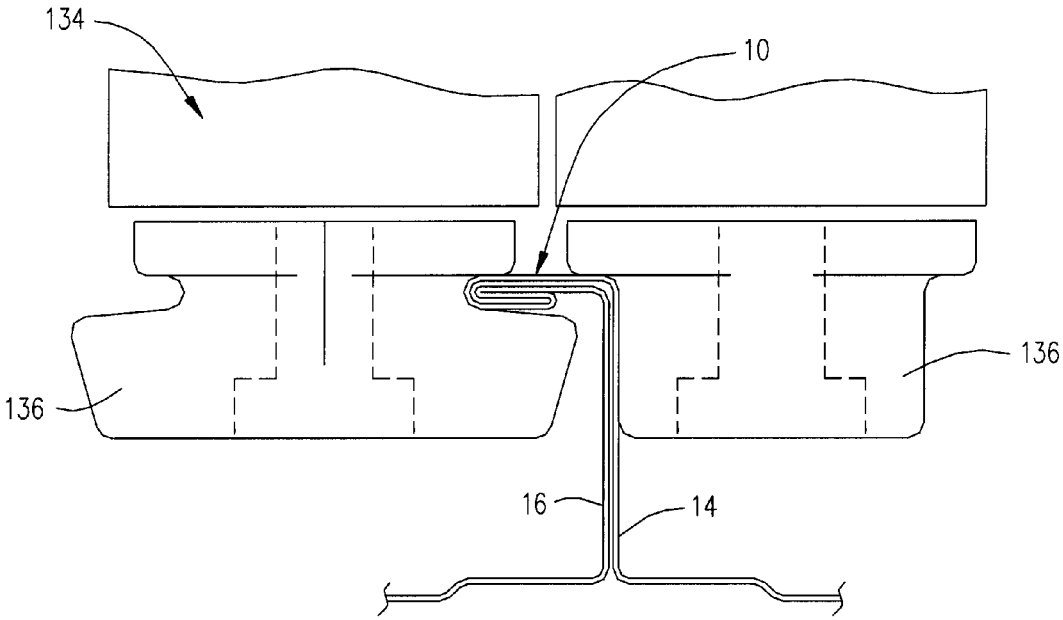
FIG. 27 is an elevational view of one of the roller sets of the seaming machine of FIG. 26 in seaming engagement with a standing seam assembly.

FIG. 27 shows one set of the opposing rollers 136 in crimping engagement with the standing seam 10. However, the seamer apparatus 134 is not in itself adequate to seam the standing seam 10 to completion as required herein. One method of adding the needed pre-forming operation to the seamer 134 shown in FIG. 26 is to add another set of rollers configured to crimp the standing seam 10, but to do so would normally require a relatively expensive modification to extend the chassis and gear mechanisms. An alternative approach is to provide a bolt-on attachment supporting an additional set of pre-crimping rollers to the front of the existing chassis of the seamer 134.

Figure 28:
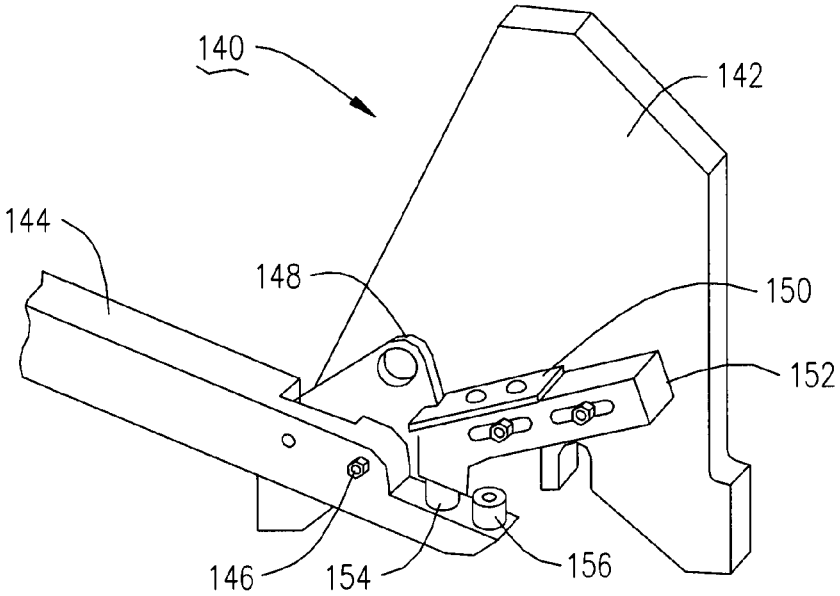
FIG. 28 is a perspective view of a pre-crimping assembly attachment for use with the seaming machine of FIG. 26.

FIG. 28 shows a pre-crimping assembly 140 that is attachable to the seamer 134 for use on a standing seam roof having flat pan sidelap portions. The pre-crimping assembly 140 has a support plate 142 that is part of the conventional prior art seamer and which supports a handle 144 that pivots about an eccentric bushing 146 depending from the support plate 142, a latch 148 pinned to the handle 144 and lockingly engageable with a latch plate 150, and a roller bracket 152 supported by the support plate 142 and supporting, in turn, the latch plate 150. The roller bracket 152 supports a first cam roller 154, and the handle 144 supports an opposing second cam roller 156.

Figure 29:
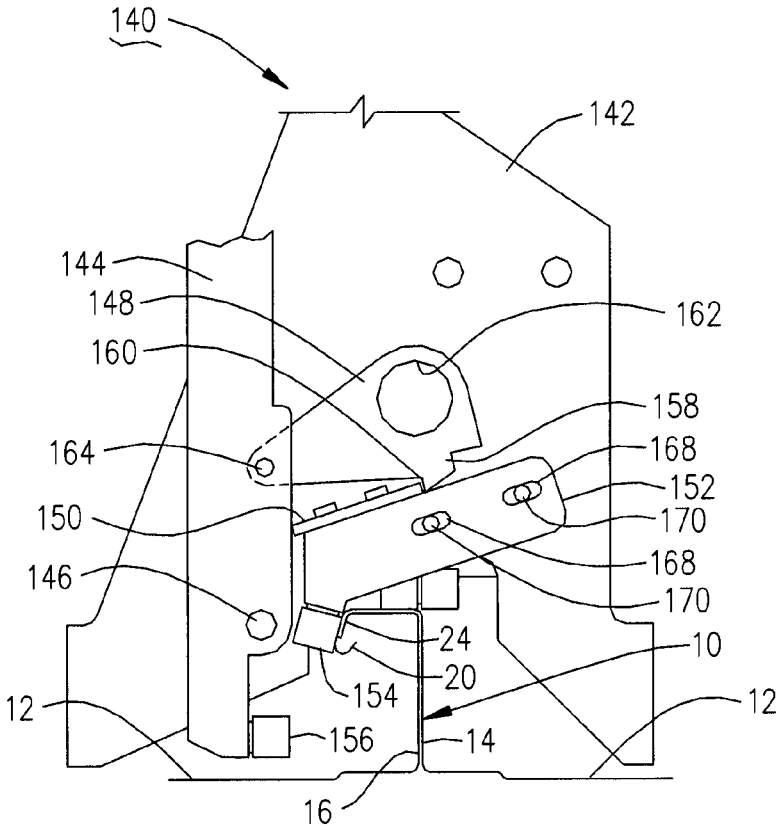
FIG. 29 is an elevational view of the pre-crimping assembly, in an open mode, of FIG. 28 for use on the standing seam assembly of FIG. 2.
Figure 30:
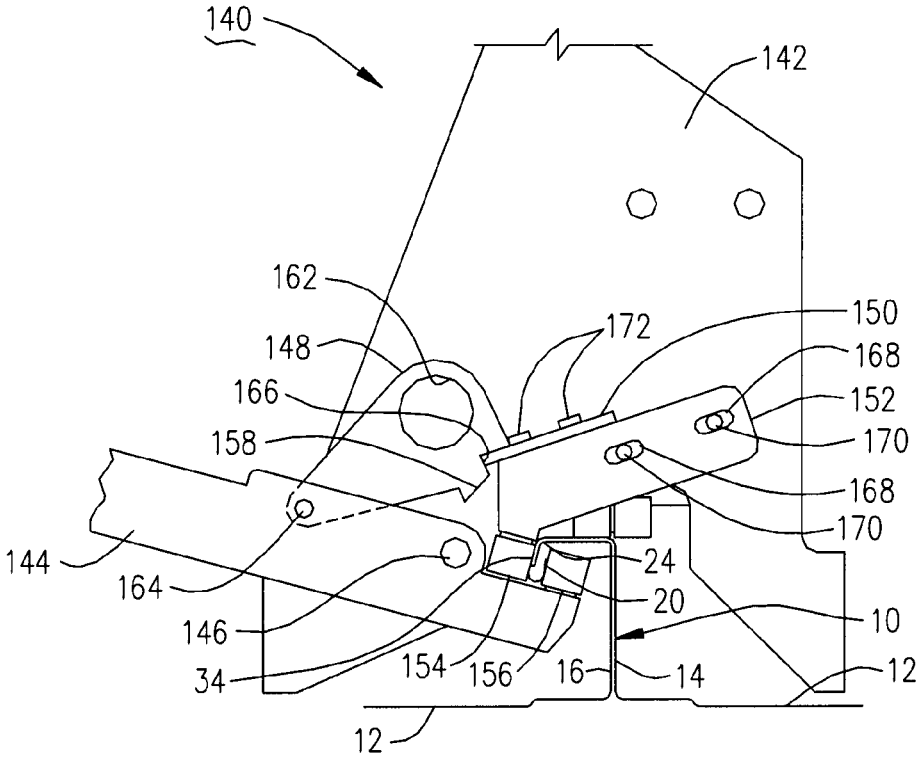
FIG. 30 is an elevational view of the pre-crimping assembly of FIG. 29 in a closed mode.

FIG. 29 shows the pre-crimping assembly 140 operably positioned adjacent a standing seam 10 in an open position, whereby the latch 148 has a locking gear 158 having a surface 160 abuttingly engaging the latch plate 150 to maintain a substantially vertical position of the handle 144, and thus retraction of the second cam roller 156 from the standing seam 10. The latch 148 has a finger hole 162 to facilitate lifting thereof about a pin 164 supported by the handle 144, thereby disengaging the locking gear 158 from the latch plate 150. This allows the handle 144 to rotate about the eccentric bushing 146 to position the second cam roller 156 into operable engagement with the hook 20 of the female sidelap 14, as in FIG. 30, which shows the pre-crimping assembly 140 in its closed position. The handle 144 is maintained in the closed position by the pressing engagement of a surface 160 of the locking gear 158 against the latch plate 150.

In use, the seamer 134 with the pre-crimping assembly 140 mounted thereon is placed in the open position (FIG. 29) and positioned adjacent the standing seam 10 that is to be field seamed. The roller bracket 152 is adjustably positionable by slots 168 and threaded fasteners 170. The roller bracket 152 is thus positioned so that the first cam roller 154 touches the female third leg 34 of the female sidelap 14. The latch 148 is then raised and the handle 144 is lowered to place the second cam roller 156 parallel to the first cam roller 154, and spaced approximately 5/32 inch therefrom, thus causing an angled forming pressure supported on an angled shaft not in a vertical or horizontal alignment. The latch plate 150 has a slot press (not shown) and threaded fastener 172, like the roller bracket 152 attachment to the support plate 142. The latch plate 150 is thus adjusted to provide a locking engagement with the locking gear 158 of the latch 148 to maintain the desired position of the second cam roller 156 in the closed position (FIG. 30) of the pre-crimping assembly 140.

Figure 31:
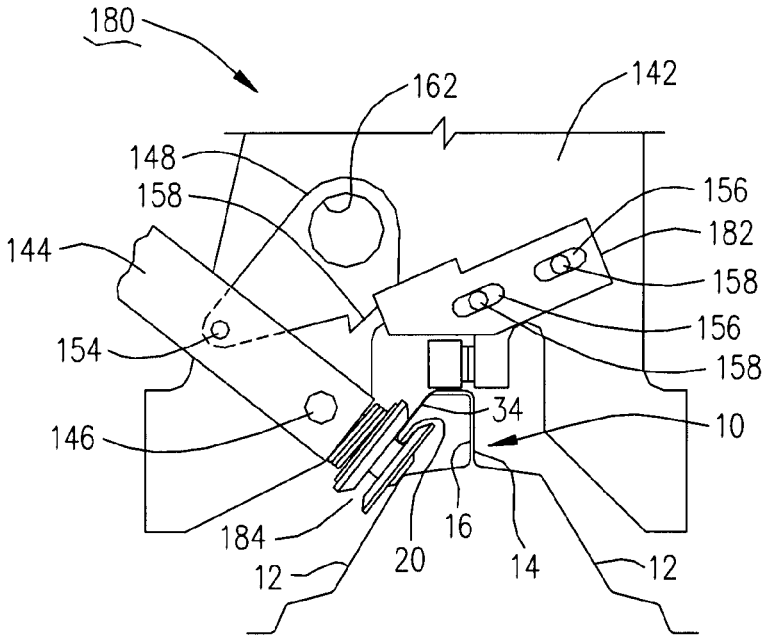
FIG. 31 is an elevational view of a pre-crimping assembly for use on the standing seam of FIG. 2 in a closed mode.

FIG. 31 shows a pre-crimping assembly 180 for use on standing seam roof panels having trapezoidal sidelap portion. The pre-crimping assembly 180 has several of the same components as the previously described pre-crimping assembly 140, namely the support plate 142 which supports a handle 144 about an eccentric bushing 146, and a latch 148 pinned to the handle 144, the latch 148 having a locking gear 158. Furthermore, a latch plate 182 supports the latch 148 in a desired angled position. The handle 144 supports a crimping roller assembly 184 at a complimentary angled position, the roller assembly shown in exploded detail in FIG. 32.

Figure 32:
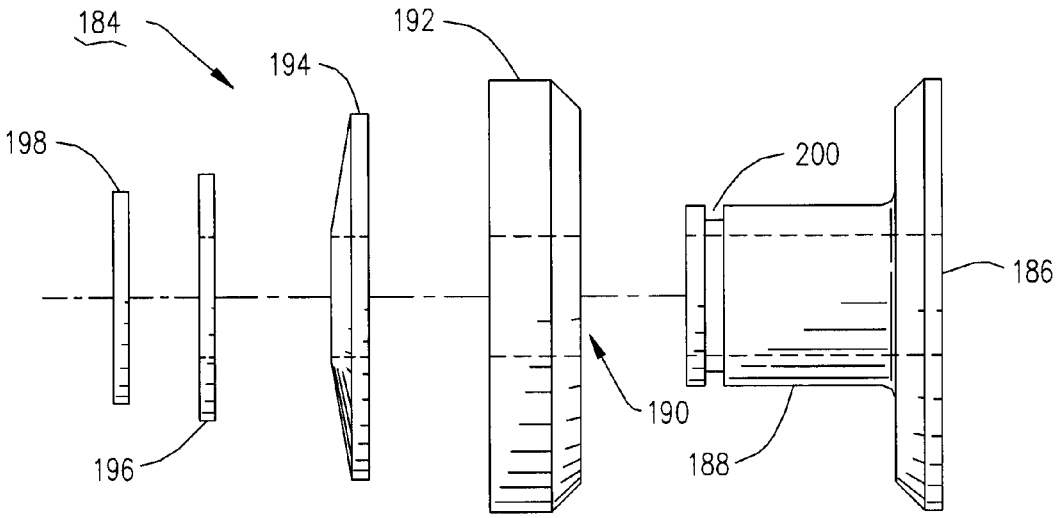
FIG. 32 is an exploded view of one style of the crimping roller assembly of the pre-crimping assembly of FIG. 31.

FIG. 32 shows the crimping roller assembly 184 as having a bottom roller 186 with a shaft portion 188 that engages a bore 190 of a top roller 192. One or more spring washers, such as a Belleville type, and a flat washer 196 are stacked on the shaft 188 against the top roller 192. If more than one spring washer 194 is used, the spring washers 194 can be stacked parallel or opposite each other to achieve the desired position and spring compression. A spring clip 198 engages a groove 200 in the shaft 188 to retain the components of the crimping roller assembly 184.

In use, the crimping roller assembly 184 is similarly set up as the pre-crimping assembly 140 discussed previously. By lifting the latch 148, the handle 144 can be lowered to bring the die crimping roller assembly 184 into operable engagement with the standing seam 10. The eccentric bushing 146 is rotated to align the roller flanges with the seam. The latch plate 182 is adjusted to place the roller assembly 184 to the proper depth of engagement with the seam 10, and the pre-crimping assembly 184 is then moved along the seam 10 to achieve the desired field seaming.

FIGS. 33-35

In the above discussion, the merits of a standing seam roof with few or no fasteners penetrating the sheet metal panels at medial portions thereof has been recognized. Generally, applications of standing seam roof panels with floating clips have capitalized on reducing the center or medial panel penetrations in order to minimize leak paths through the roof. At times, however, the lack of medial fixed panel attachment to underlying support structure can result in an undesirable reduction in diaphragm strength of the roof or wall, resulting in a need for additional bracing.

In order to achieve adequate diaphragm strength, the panels making up the roof or wall must possess a number of qualities. One such quality is resistance of a panel sliding in relation to adjacent panels. This quality is referred to as in-plane panel sidelap shear capacity. Sidelap shear capacity, or resistance to panel sliding, can be achieved in a number of ways.

A sufficient diaphragm strength is necessary to prevent the panels from "saw-toothing" when subjected to a lateral "racking" load. The panel must also possess sufficient in-plane strength such that the panel does not buckle as load is applied. The panel may be strengthened by adding ribs or corrugations and by attaching floating clips to a substrate with sufficient rigidity to hold the panel and panel roof in place so it cannot develop major buckles involving multiple panels.

Figure 33:
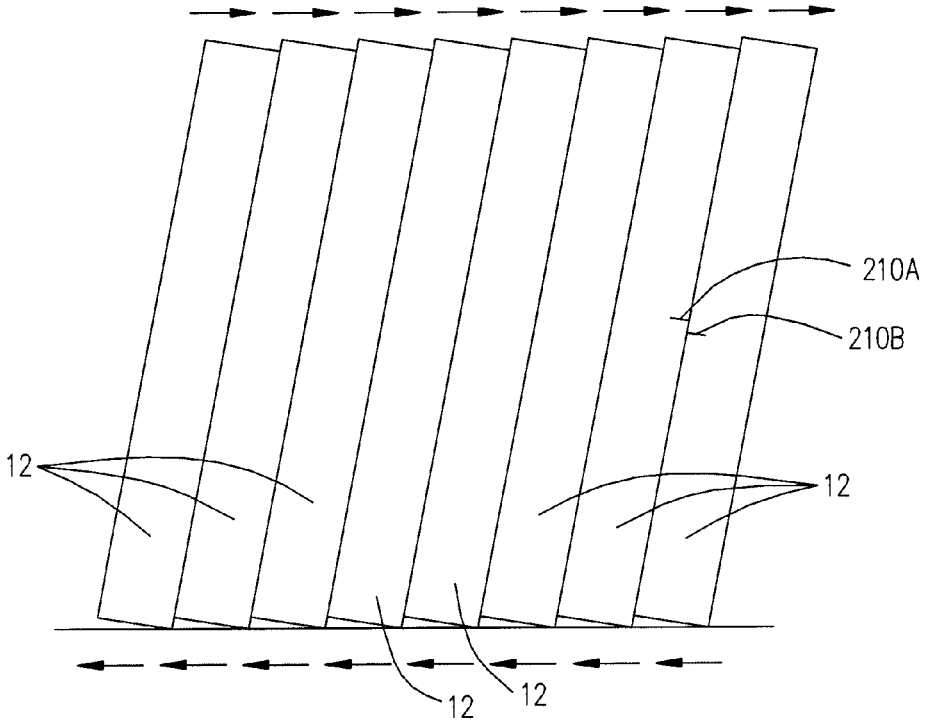
FIG. 33 is a diagrammatical representation depicting adjacent roof panels resisting in-plane distortion when subjected to loading.

Sidelap shear is illustrated in FIG. 33 in which is depicted a plurality of roof panels 12 that are depicted as resisting unfurling when subjected to uplift loading. That is, FIG. 33 represents a portion of adjacent panels, such as metal roof or wall panels, that are subjected to diaphragm loads occurring in the opposite sidewall or in the roof of the metal building as load is applied to the building. Another such effect is found when a floating standing seam roof that is supported by zee purlins; as the roof is subjected to downward load, the purlins tend to rotate in the direction of the compression flange. In this case, the diaphragm strength of the roof helps prevent such movement and stiffens the purlins between purlin to frame attachment points. The opposing force arrows (not separately designated) depict this diaphragm shearing load.

For the panels 12 to resist the diaphragm load, among other things, the panels must resist movement, or sliding, or adjacent panels. To illustrate the shearing movement under such load, a pair of marks 210A and 210B are depicted at the edges of the adjacent panels in FIG. 33; under prior normal conditions, the marks 210A, 210B were aligned prior to the time that sideward movement has occurred in the panels 12. As depicted, without medially securing the panels 12 to the underlying structurals, the pans 12 are permitted to slidingly rotate as illustrated by the misalignment of the marks 210A, 210B. The phenomenon illustrated in FIG. 33 results from a lack of in-plane panel sidelap shear capacity of the panels 12 as mounted. Once installed, provides an appropriate degree of panel sidelap shear capacity for the panels 12, and the panels will remain in the installed position so that the marks 210A, 210B will remain aligned under diaphragm shearing load.

Standing seam diaphragm strength benefits a building structure in several ways. It can serve to stiffen the structural members when the roof is appropriately secured and it can also serve to transfer roof applied loads to the parallel shear walls. Standing seam panel roofs possessing adequate diaphragm strength can also transfer horizontal load, such as from wind or earthquake loads applied to the roof, to the shear walls that are capable of resisting loads in a parallel direction. In this situation, the connections between the roof and the supporting structurals may or may not transfer shear load. However, the connections can stiffen the roof and the plane of the roof. To effectively transfer such loads, the roof must be adequately attached to the shear walls as in FIG. 33A.

In order to achieve the structure stability illustrated in FIG. 33A the panel must be securely anchored to adequate shear walls, resist sidelap slippage and not only buckling with in a given panel but also major buckling across multiple panels. Buckling within a single panel may be prevented by minor corrugations in the panel and major buckling may be prevented if the roof is held in its pre-existing plane by such things as floating clips anchoring it at a fixed distance from a substantially rigid substructure such as an adequate failure resistant support system.

Figure 34:
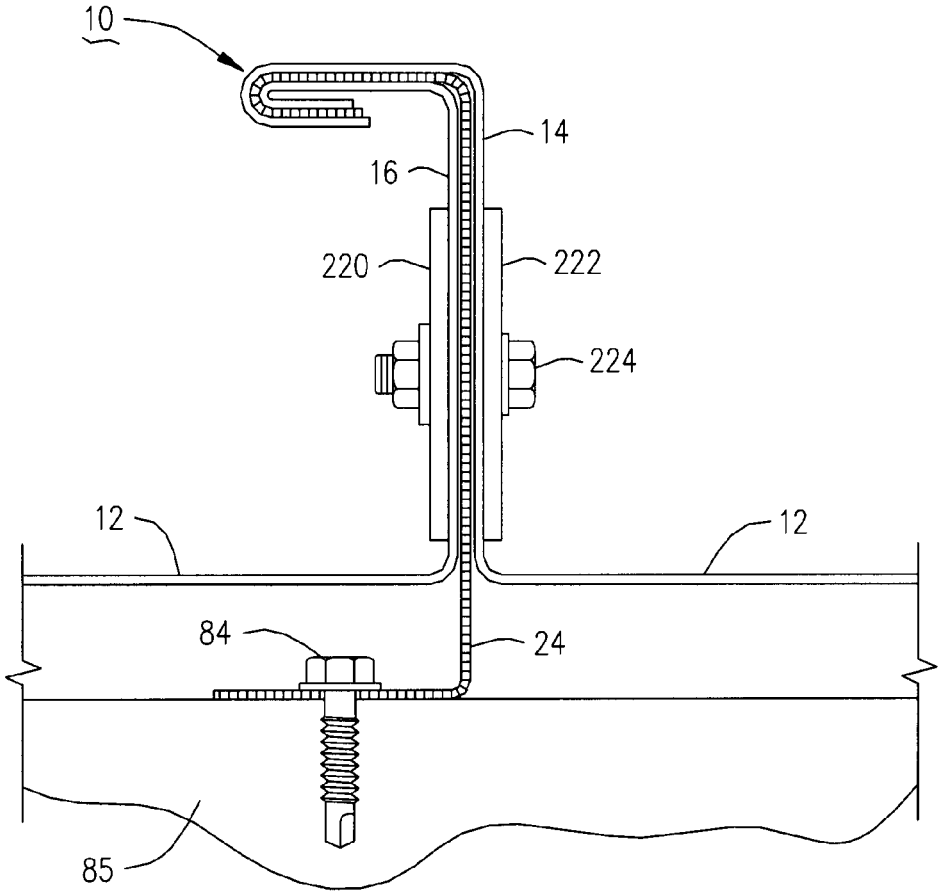
FIG. 34 is a diagrammatical representation showing one other seamed configuration of adjacent roof panels resisting in plane shear movement when subjected to load.
Figure 35:
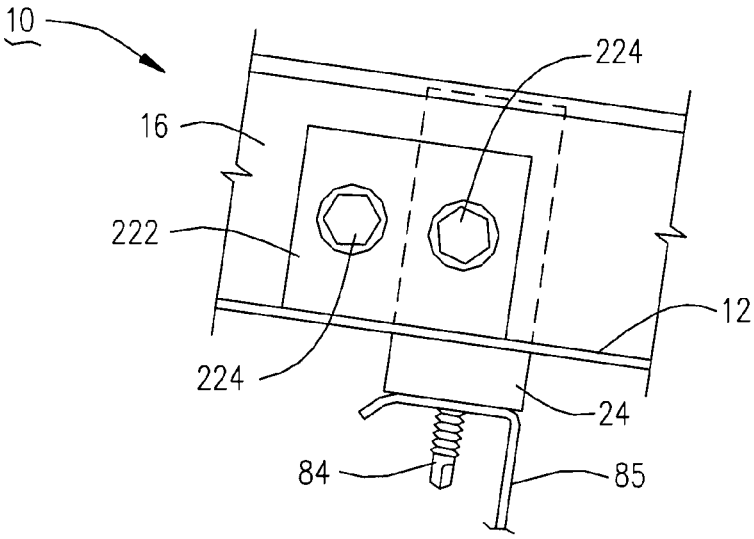
FIG. 35 is an elevational view of the standing seam of FIG. 34.
Figure 3G:
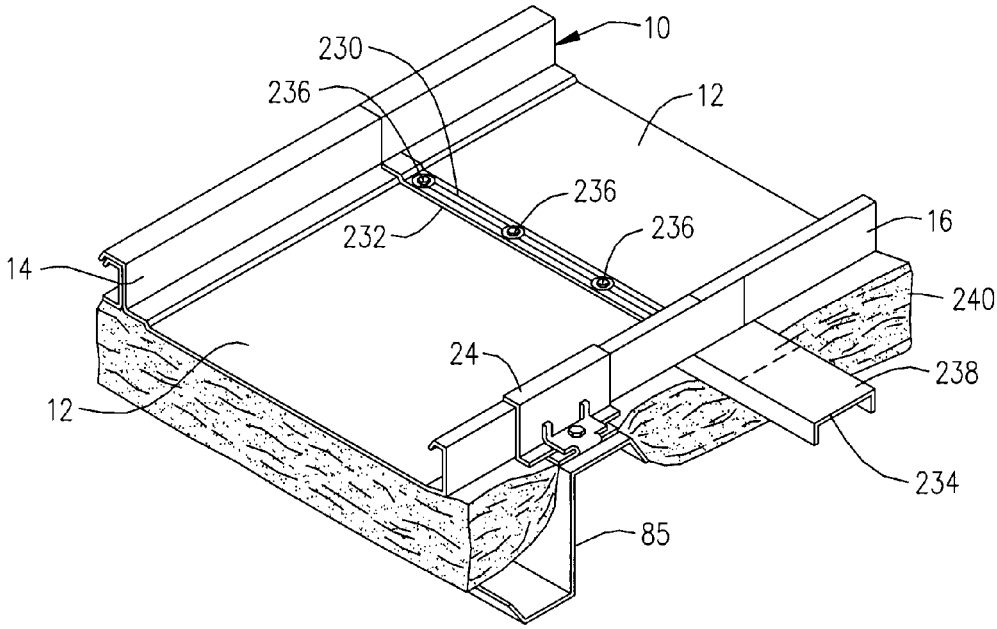
Figure 3H:
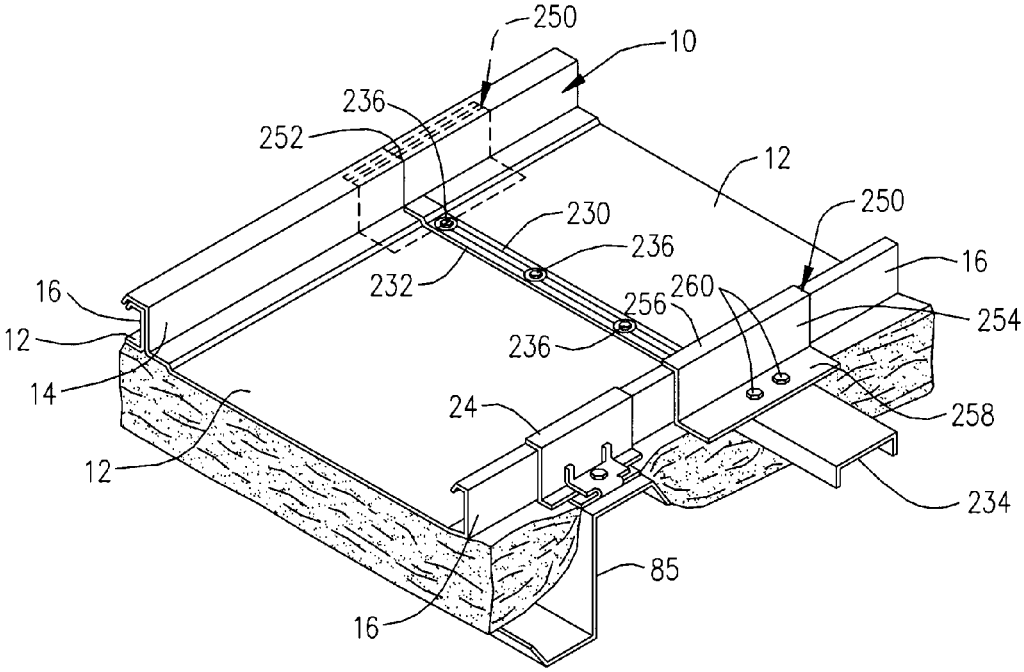

Diaphragm strength is increased by attachment of a backer plate on the upstanding portions of the sidelaps, as illustrated in FIGS. 34 and 35. Shown therein is a brace plate 220 engaging the female sidelap 14 and a brace 222 engaging the male side lap 16 in the standing seam 10 of interlocking adjacent roof panels 12 supported by the underlying building support structure 224. One or more fasteners 224 (FIG. 35) connect the brace plates 220, 222 to compressingly sandwich the sidelaps there between. The tightened fasteners 224 increase the frictional and shear resistance between the sidelaps 14, 16 to prevent relative sliding movement thereof.

Preferably, the brace plates 220, 222 are used in protected areas of the roof, such as the ridge of a building that is protected by ridge trim, so that the through fasteners 224 are not visible and are not exposed to the weather elements.

Other embodiments that increase the resistance of the female sidelap 14 to sliding in relation to the clip 24 and the male sidelap 16 are shown in previously discussed FIGS. 13-17, 21.

FIGS. 36-41

Figure 37:
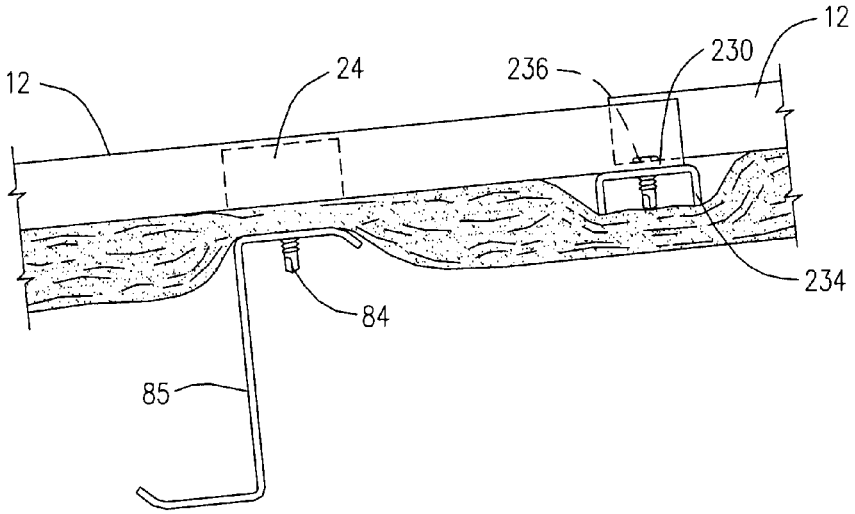
FIG. 37 is an end view of the standing seam roof assembly of FIG. 36.

Another embodiment that increases the diaphragm strength of a standing seam roof is a backer and optional cinch plate assembly that can be installed at a panel endlap, a ridge or an eave location. FIGS. 36 and 37 show an optional cinch plate 230 placed on top of roof panel 12, which is in turn is placed over a tape sealant 232 at the panel endlap location. A backer member 234 (or beam, which can take numerous shapes) is positioned under the cinch plate 230, and a number of fasteners 236 are used to draw together: the cinch plate 230 (or the panel 12 if no cinch strap is used); and the backer member 234.

The backer member 234 can be made up of a series of pieces, a partial one being a channel member 238 joined by a vertically and horizontally moment and shear connection plate 240 to make the channel member 238 into one substantially continuous backer member 234. The backer member 234 extends under, and bridges between, adjacent panels 12, which are similarly attached to the backer member 234 via additional cinch plates 230 and fasteners 236. Thus, the multiple cinch plates 230 and fasteners 236 sandwich the panels 12 to the underlying backer member 234. The tightened fasteners 236 also increase the lateral resistance to sliding of end-to-end overlapped panels and the backer member 234 extending between adjacent panels.

The fasteners 236 increase shear resistance to prevent sliding between adjacent panels 12 in the vicinity of their panel endlap portions. The beam and shear strength of the backer member 234 serves to prevent adjacent panels from sliding in relation to each other. FIG. 37 shows an end view of the cinch plate 230 and the backer member 234 of FIG. 36. A similar bridging arrangement between adjacent panels to prevent relative sidelap movement was discussed above with reference to FIGS. 34 and 35 for an eave or ridge condition. Except as modified herein, FIG. 36 is a typical panel endlap of the type commonly found in the art, with the overlapping panels fastened together with the fasteners 236.

FIG. 38 shows the incorporation of a strengthening beam 250 in a standing seam sidelap at a point of discontinuity 252 (also see alternative embodiments of FIG. 50), that is in these illustrative embodiments, at the location of a panel end-to-end overlap. Frequently, this point of discontinuity will occur away from where the panels cross underlying building support members, such as the underlying structural 85.

The strengthening beam 250 has an upstanding web portion 254 and an upper ledge portion 256. The strengthening beam 250 has a supporting flange 258 at the lower end of the web portion 254. In practice, the strengthening beam 250 is a unitary sheet metal member that is formed so that the upper ledge portion 256 and the supporting flange 258 extend in opposite directions and normal to the middle web portion 254.

The strengthening beam 250 is configured so that the upper ledge 256 fits over the top of the male sidelap 16 and the web portion 254 fits against the upstanding male first leg 44. Thus, when the female sidelap 14 is positioned over the male sidelap 16, the upper ledge 256 and the web portion 254, and these are seamed together to form the standing seam 10, the strengthening beam 250 serves to increase the load capacity thereof. Optionally, the strengthening beam 250 can be attached to the underlying backer member 234 by fasteners 260 extending through the supporting flange 258.

Figure 39:
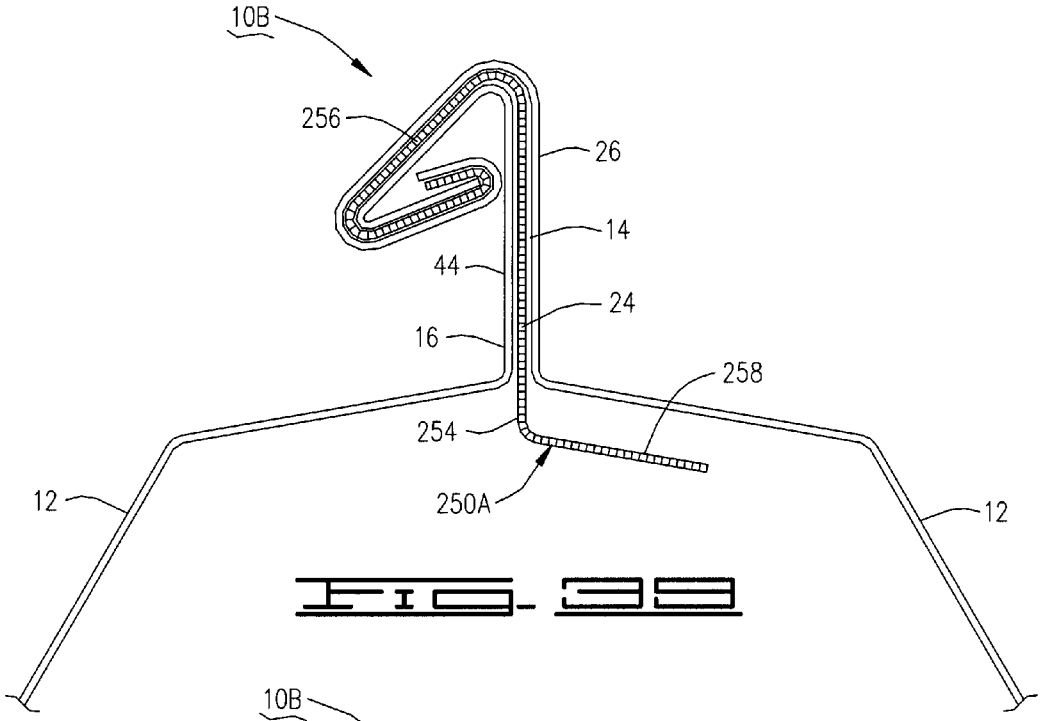
FIGS. 39 and 39A are end views of the standing seam of FIG. 5 having modified strengthening beams.
Figure 39A:
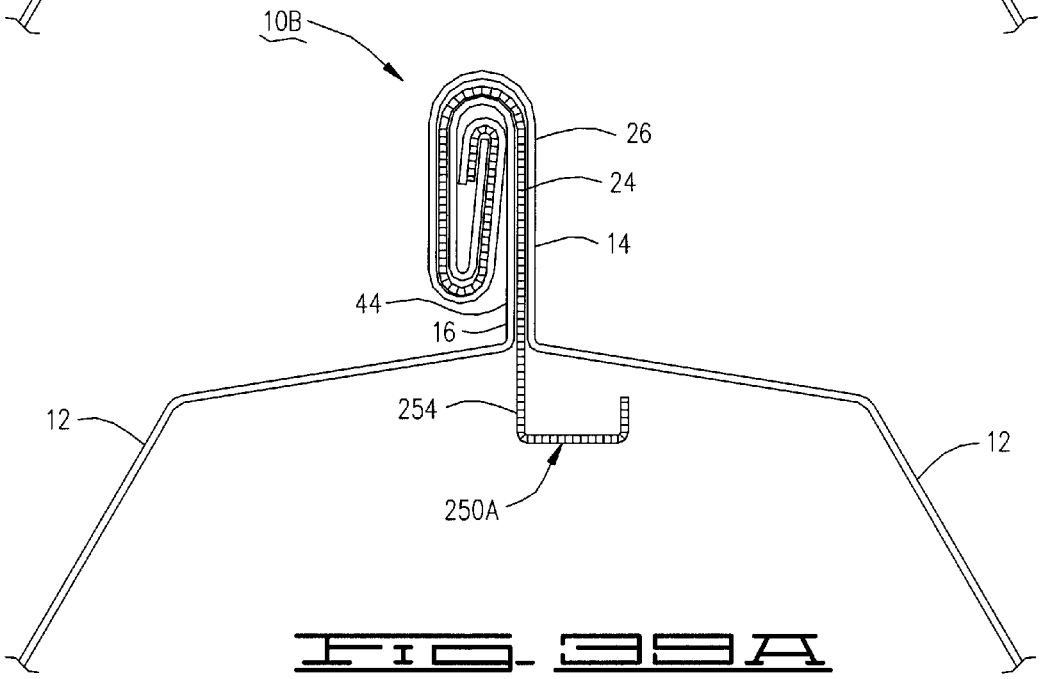

FIGS. 39 and 39A show a strengthening beam 250A having modified configurations, connected to, and seamed into, the standing seam 10B (described above with reference to FIG. 5) at the discontinuity 252 (an end-to-end panel overlap) and panel deflection between locations of clips 24. It will be noted that, as depicted in FIG. 39, the upper ledge 256 and the web portion 254 have been seamed into the standing seam 10B, while the lower flange 258 has been bent to form an obtuse angle with the web portion 254, assuring clearance of the profile of the panels 12 and further strengthening the beam strength of the web portion 254. In FIG. 39A, the flange 258 can be further strengthened by bending its edge portion 258A substantially normal to the flange 258, as shown.

Another way of increasing the diaphragm strength of the roof panels 12, often in combination with the other means disclosed hereinabove, is to utilize fasteners 236 to secure the eave row (not shown) of the panels. That is, fasteners 236 can be used to attach the ends of the roof panels 12 directly to an eave strut or to a support member that is itself fastened to an eave strut, thus often serving as a shear wall.

Figure 40:
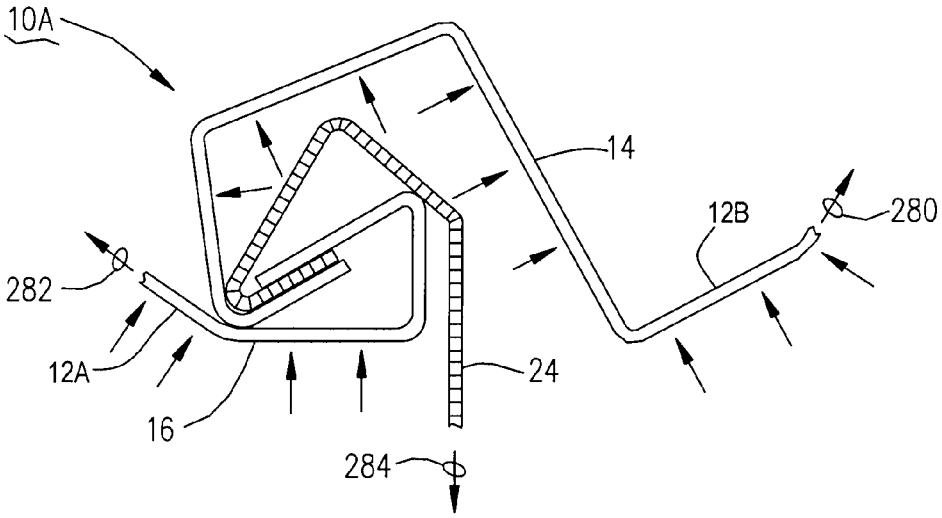
FIG. 40 is an elevational view of the standing seam assembly of FIG. 4 illustrating the standing seam assembly subjected to applied load forces.
Figure 41:
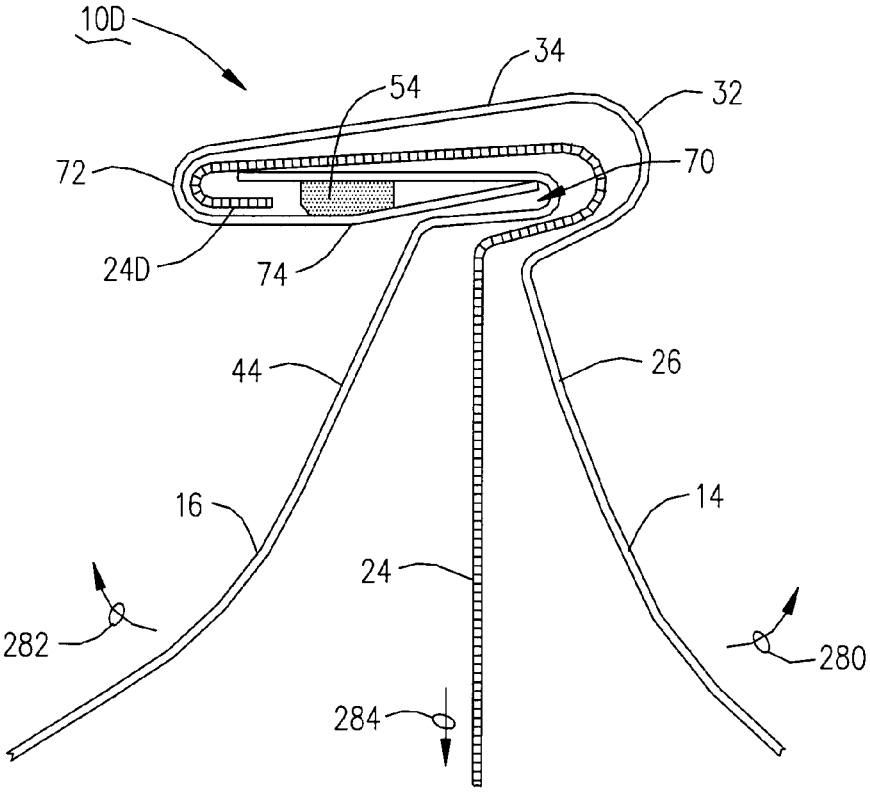
FIG. 41 is an elevational view of the standing seam assembly of FIG. 7 as subjected to upwardly applied load forces.

FIGS. 40, 40A and 41 illustrate the manner in which the standing seam 10A and 10D resist unfurling, or unzipping, when subjected to uplift loading. As depicted in FIG. 40, uplift forces tend to lift and rotate especially the center portion of the roof panels 12A and 12B, and this is resisted by the standing seam and clip 10A (FIG. 4). The lifting and rotating force on the female sidelap 14 is along the directional arrow 280. The lifting and rotating force on the male sidelap 16 is along the directional arrow 282. A downward force in the direction of arrow 284 is exerted by the clip 24, resulting in the force balance and secure attachment of the standing seam 10A to the underlying support structural (not shown).

The amount of deflection illustrated by the uplift forces in FIG. 40 is idealized, dramatic and beyond the elastic limit of the panels 12A, 12B. Even so, the standing seam integrity is maintained far beyond the limits of other panels without these panel features so that the adjacent panel seams do not unfurl or unzip. It will be noted that the radius portion 286 of the clip 24 is lockingly engaged with the male tab member 52 so that the forces 280 and 282 will not separate the clip 24 from the male sidelap 16. Further, it will be noted that the male sidelap 16 is lockingly engaged with the female sidelap 14 so that the forces 280 and 282 do not separate them.

Further, it will be noted that, from FIG. 41, the uplift forces 280, 282, which tend to lift and separate the female and male sidelaps 14, 16, produce forces in opposite directions on the tab member 74 and the retaining groove 70, so as to drive the tab member 74 evermore into the retaining groove 70. For this reason, the uplift forces 280, 282 will not succeed in unfurling the standing seam 10D.

With reference to FIGS. 34-35, there are two principal reasons that the disclosed securing means—purposed to increase the diaphragm strength of building roofs and walls—may not be accepted in the industry as readily as they might otherwise be. People often object to bolts, nuts and fasteners penetrating roof panels from outside because the fasteners can corrode and leak, and some will argue that such penetrating members impair the aesthetic quality of the roof or wall structure. When using the apparatuses of these embodiments, it is desirable that they be made as attractive, unobtrusive and inconspicuous as possible, and this may in certain instances negate their selection. However, times have seen changing needs that have increased the acceptance of these improvements.

One such change is that there has been an increasing appreciation that diaphragm strength directly impacts the structural strength of zee purlins that support roof panels. Technical requirements relating to the stability of zee purlins are becoming much more rigorous, as is the demand for stability of the overall building structure. Diaphragm strength can contribute directly to both of these, thus mitigating the objections mentioned above.

In the use of the backer member 234 of FIGS. 36-38, it is preferable that the fasteners 236 be located as close to the end edges of the panels 12 as practical to minimize buckling of the cinch plate 230, the backup member 234 or the panels 12 as the joint is subjected to shear load. If the bolts extend through their nuts, the sealant between the nuts and the surfaces of the male sidelap 16 will be forced around the bolt threads by pressure exerted by the bolts to form water type joints.

Aesthetics and functionality may be improved when using the base plates 220, 222 as disclosed in FIGS. 34 and 35 by the use of flat head bolts with the fasteners 224; also, by locating the flat heads of the bolts against the surfaces of the female sidelap 14. Preferably, the bolt heads will be large enough to distribute their compressive loads over appropriately large areas, and that such fasteners 224 be utilized in such a manner as to make them as inconspicuous as possible. The underside of the bolt heads are preferably coated with an appropriate sealant material to seal between the bolt heads of the fasteners 224 and the surfaces of the female sidelaps 14. The bolt nuts are preferably located beneath the projecting standing seam 10 to at least partially conceal the bolt nuts, making them inconspicuous by finishing and forming them so as not to be obtrusive.

Mention should also be made that an "acorn" nut can be used with the fastener 224. An acorn nut is one that covers the end of the bolt so that there is no leaking between the bolt threads and the nut threads from the outside end of the bolt. For an acorn nut, the bolt must be coordinated with the thickness of the material in the bolt grip after the nut has been applied, so that the depth of the bolt does not penetrate the full depth of the acorn nut. This will enable the nut and the bolt head to force the material gripped between them to form a watertight, structurally sound, aesthetically acceptable joint. These may be located at a panel clip, in between panel clips or periodically spaced throughout the length of the panel standing seam at critical locations, such as at panel endlap splices, the ridge and/eave structures or other locations.

The embodiment of FIGS. 34 and 35 may be used in conjunction with other panel devices, such as the back-up plate and cinch strap of FIGS. 36 and 37, to achieve the required diaphragm strength. If such is used with a clip, the clip may be a floating or fixed clip, and by such selection, it may also have the beneficial effect of strengthening the panel to increase the resistance to wind uplift. Preferably, all bolts and nuts are made of corrosion resistant material, such as stainless steel, which will improve the functional performance and acceptability thereof.

Several embodiments that increase diaphragm load bearing ability have been disclosed herein: FIG. 6 (serrated teeth 64 on the clip 24); FIGS. 16-17 (crimp 92 staking female sidelap 14 and male sidelap 16 together to prevent longitudinal in-plane movement between adjacent panels); FIGS. 36-37 (backer plate 234 and cinch plate 230 that sandwich end-to-end overlapped panels) and FIGS. 38-39 (adding the strengthening beams 250 or 250A thereto); and FIGS. 34-35 (brace plates 220, 222 that sandwich the upstanding portions of the female and male sidelaps 14, 16 to increase the frictional shear resistance between adjacent panels to prevent in-plane movement there between).

These diaphragms strengthening means may be used separately or in combination at specific areas of building roof or wall portions, such as at particular areas more likely to sustain diaphragm shear loading as required in the various zones thereof. U.S. Pat. No. 6,588,170 entitled Zone Based Roofing Systems, issued Jul. 8, 2003, discusses such zones, and the disclosure of this patent is hereby incorporated herein by reference for such purposes as may be necessary.

With regard to the brace plates 220, 222 of FIGS. 34 and 35, the material through which the bolt penetrates is best proved as compressed when a bolt with an acorn nut is used, as the grip of the fastener will have a limited range, which may not be sufficient to reach completely through the material if the material is not compressed prior to applying the acorn nut. This can be achieved by applying compression to the material next to a pre-drilled hole using tong pliers, a vice grip type device or basically, specially formed pliers with enlarged jaw gripping surfaces.

Another device that will increase the frictional resistance between adjacent panels, thereby increasing the resistance to shear forces, is a U-shaped member (not shown) having a slot into which the standing seam can be received, and having threaded apertures through which threaded rods can extend to exert closing pressure on the joined panels as the elements of the seam are brought together. Since frictional resistance is normally proportional to applied pressure, the sectional resistance and resistance to shear movement between adjacent panels is increased. These pressure apparatuses can be used in conjunction with the serrated plate of FIG. 14 to increase rigidity.

Importantly, the overlap of the backup plate of FIGS. 36 and 37, or the bolted plates of FIGS. 34 and 35, should be continuous at each joint between adjacent anchor points. Also, it is advisable that anchor devices be used intermittently, such as at primary support points or at the end of panel runs, to transfer the shear/diaphragm load from the roof panels to the supporting structure member. These should be capable of resisting the diaphragm or shear force developed in the roof or wall.

FIGS. 42-44

Figure 42:
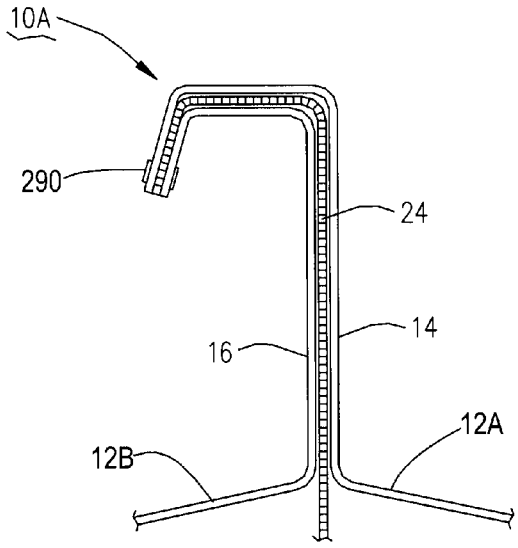
FIG. 42 is an elevational end view in cross-section of yet another alternative standing seam with a clip tab between the male and female corrugation with a fastener inserted through the male and female seam.
Figure 43:
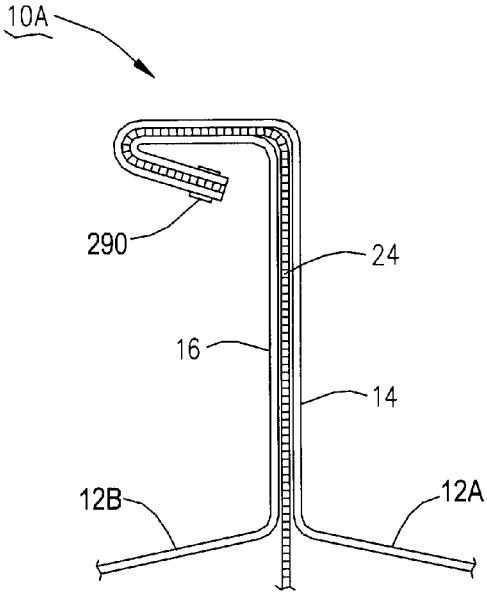
FIG. 43 is an elevational end view of the standing seam of FIG. 42 after seaming.

FIG. 42 shows another alternative standing seam 10A with a clip 24 between the female sidelap 14 and the male sidelap 16, the standing seam having a rivet fastener 290 inserted through the proximal edges of the female and male sidelaps 14, 16 and clip 24. This configuration prevents plane shear movement between all three elements of the standing seam 10A, that is, movement between the female sidelap 14, the male sidelap 16 and the clip 24. The rivet fasteners 290, spaced at intervals along the sidelaps, also increase the panels' resistance to unfurling when subjected to uplift forces. The rivet fasteners 290, located outside (outboard) of the sealant (not shown in this figure) so water tightness of the seam is not impaired, are easily installed through the last element. FIG. 43 shows the standing seam 10A of FIG. 42 after seaming, which tightens the seam and hides and protects the rivet fasteners 290.

Figure 44:
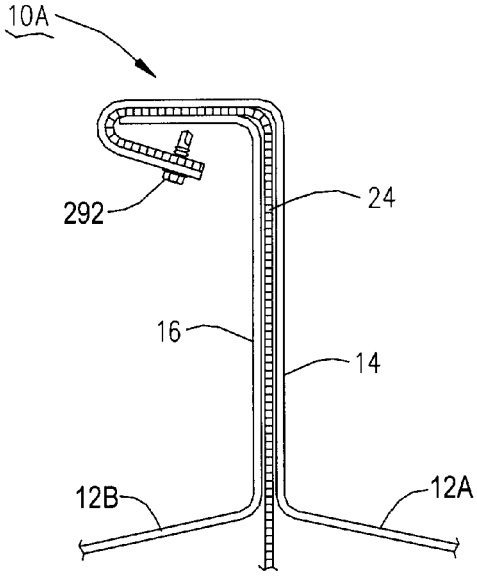
FIG. 44 is an elevational end view of the standing seam of FIG. 43 with a different fastener.

FIG. 44 shows the standing seam 10A with a screw fastener 292 extending through, and attaching, any two of the three elements (the male and female sidelaps 14, 16, and the clip 24) to increase in-plane shear resistance between any two of the elements of the seam as required, and to increase resistance to unfurling. The screw fastener 292 as illustrated in FIG. 44 is preferably a self-tapping, self-threading screw member. It will be understood that equivalent fasteners can serve as the rivet fastener 290 or the screw fastener 292, such as a weldment or an adhesive.

FIGS. 45-46A

FIG. 45 shows a modification to the standing seam 10 of FIG. 2. Briefly, the standing seam 10 as depicted in FIG. 45 has the clip 24 sandwiched between the female sidelap 14 and the male sidelap 16, and then has been field seamed.

The female sidelap 14 comprises the female first leg 26, the female first radius portion 28, the female second leg 30, the female second radius portion 32 and a female third leg 34A, which form the female first cavity 36 and the female second cavity 38 (the first and second male insertion cavities, respectively), for receiving the male sidelap 16. The female retaining groove 40 is disposed at the edge of the female third leg 34A, the female fourth leg portion 42 extending from the female third leg 34A to form the female retaining groove 40.

The male sidelap 16 comprises the male first leg 44, the male first radius portion 46, the male second leg 48, the male second radius portion 50 and the male third leg 52 (the male tab member) disposed in the female first cavity 36. The male second radius portion 50 is disposed in the female second cavity 38, and the edge of the male tab member 52 is disposed in the female retaining groove 40.

The clip radius portion 25A is shaped to conform to the curvature of the female first radius portion 28 and the male first radius portion 46. The clip second radius portion 25 lockingly engages the male second radius portion 50 in the female second cavity 38.

The end of the clip third leg 24C is lockingly engaged in the female retaining groove formed by the female third leg 34A and the hook 20. The hook 20 wraps the male tab 52 and the clip third leg 24C. A mastic material 54 is disposed in the female retaining groove 40 to seemingly engage the distal end of the male tab 52, providing a water tight seal for the standing seam 10.

Having above described the particulars of the standing seam 10 as depicted in FIG. 45, attention will now be directed to the modification of the female third leg 34A. Instead of being a straight portion as previously described with reference to FIG. 2, it will be noted that the female third leg 34A is crimp formed as shown in FIGS. 7 and 20 to have an angled bend apex at point 61, the female third leg 34A being thereby bowed away from the other elements.

As described above, the standing seam 10 has a multiple lock integrity, whereby standing seam 10 is secured by the male first portion 46 in the female first radius portion 28; the male second radius portion 50 in the female second radius portion 32; and the male third leg 52 (the male tab) in the female retaining groove 40.

The male tab 52 acts as a locking tab engaging the female retaining groove 40 to resist unfurling, or unzipping, by uplift forces. When the panels 12 forming the standing seam 10 are subjected to uplift load, such as by wind, pivoting disengagement is attempted by the separation of these members, and as this occurs, the male tab 52 and the female retaining groove 30 permits some upward flexing of the adjacent roof panels 12, while maintaining the latching integrity of the sidelap portions 14, 16 and closure of the standing seam. Furthermore, the hook 20 wraps around and secures the male tab 52 and the clip third leg 24C.

The crimped female third leg 34A, when flexed as in a wind uplift condition, serves as a back wound, flexed spring that further resists unfurling, or unzipping, at the standing seam 10. Thus, the multiple lock integrity is enhanced as the standing seam 10 resists not only unfurling under uplift loading, but also gravity, shear and rotation forces applied thereto.

FIG. 46 shows a standing seam 10A in which, like the standing seam of FIG. 4, the female second leg 30 extends normal to the first leg 26. The proximal edge of the male tab 52 of the male sidelap 16 is disposed in the clip retaining groove 60, which in turn, is in the female retaining groove 40 of the female sidelap 14. The hook end 21 of the hook 20 sets adjacent to the end of the clip fourth leg 24D, and mastic 54 seals the edges of the female sidelap 14 and the male tab 52. Both the hook 20 and the clip fourth leg 24D wrap and secure the male tab 52, and the hook 20 reinforces and secures the clip fourth leg 24D.

As with the above described standing seam 10 of FIG. 45, the female third leg 34A is crimp formed to have an angled bend apex at point 61, thus being bowed away from at least some other elements. The crimped female third leg 34A, when flexed as in a wind uplift condition that tends to unfurl, or unzip, the standing seam 10A, serves as a back biased, flexed spring to prevent against seam failure, enhancing resistance to uplift load as well as reinforcing resistance to gravity, shear and rotation load forces.

The crimped female third leg 34A when flexed inwardly in the seaming operation allows the distal ends of male third leg 52 and clip leg 24C to be extended further into female retaining groove 40 then as the seaming operation release the inward pressure on angled bend 61, female third leg tends to return to its original shape thus bringing the female cavity closer to the distal ends of included members such as male third leg 52 and/or clip third leg 24C and increases the corrugations' resistance to unfurling and failure.

Figure 45A:
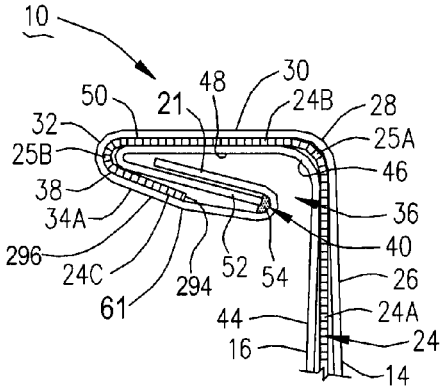
FIG. 45A is an elevational end view of a modified embodiment of the standing seam of FIG. 45.

FIGS. 45A and 46A show yet further modifications to the standing seams 10 and 10A of FIGS. 2 and 4, respectively. Having previously described the particulars of the standing seam 10 depicted in FIG. 45, attention will be directed to the modifications of female third leg 34A and truncated clip portion 294 which generally parallels the first portion of female third leg 34A, now designated as 296.

The truncated clip portion 294 may be flexed inwardly in the seaming operation in the same manner as the female third leg 34A, and after release of the seaming pressure, it tends to return to its original shape, bringing the female retaining cavity 40 closer to the third female leg 52. The force of the truncated clip 294 adds to the force of the third female leg 34A, thus increasing the resistance of the standing seams to unfurling and failure.

In FIG. 46A, the clip third leg member 24C has been crimp formed to substantially conform to the crimped female third leg 34A to have an angled bend apex conforming to the point 61; thus, flexing serving as an additional back wound, flexed spring that further resists unfurling (unzipping) of the standing seam 10A.

FIGS. 47-51

In the art of constructing metal buildings, metal roof panels are supported at spaced apart support points, that is, with the panels spanning between two and twelve feet; and the metal roof panels are strengthened with longitudinal ribs or corrugations. Thus, the panels can be considered as acting as continuous beams when design loading calculation is undertaken. For example, under uniform loading, continuous beams spanning three or more points of support possess moment and shear curves that are maximum at the points of support, and they are subject to failure at the point of attachment.

It should be noted that moment drops off very quickly away from the support points, while shear diminishes more gradually and is significantly less as the distance from the support increases. Because of this, a standing seam metal roof panel develops high stress at its support points, and it would be desirable to reinforce the panel, particularly the panel seam, at these points along the seam and at points of discontinuity, such as at panel endlaps.

Panel reinforcement can be accomplished in a number of ways, but an effective way is by using strategically located strengthening beams that fold into the seam and serve to strengthen the seam at these critical points. In tight fitting seams, the sidelap of the panel can be wrapped around a strengthening beam 250 (or such strengthening beam can be incorporated into a panel clip) that will connect the clip/beam to the panel seam so that the clip/beam becomes integral with the seam.

In this regard, it is preferable to select a strengthening beam length and strength that is appropriate to achieve the desired panel strength required for a particular span, load, location and related variants that are factors under the specific conditions. In all, with other things being equal, a longer, stronger clip tab reinforcing beam or a reinforcing beam placed at a critical location is desirable for greater loads and longer panel spans.

FIGS. 47-51 show a panel clip 300, also referred to herein as the strengthening or reinforcing beam 300. Here the strengthening beam is an integral part of the clip tab 302 and a relatively short clip base 304. The panel clip 300, serving as a reinforcing beam, is generally configured to optionally incorporate one or more of the desirable features of the clip, such as sealant transfer holes, as that disclosed in U.S. Pat. No. 5,692,352 entitled Roof Panel Standing Seam Assemblies; U.S. Pat. No. 6,588,170 entitled Zone Based Roofing System; U.S. Pat. No. 6,889,478 entitled Standing Seam Roof Assembly Having Increased Sidelap Shear Capacity of the present inventor, and these patents are incorporated herein by reference.

The reinforcing or strengthening beam is particularly beneficial in strengthening panels in high wind uplift load zones such as disclosed in U.S. Pat. Nos. 6,823,642 and 6,588,170, wherein the strengthening beam disclosed herein forms a part of a roof demand and zone based roofing method for constructing a roof of metal panels for a building having a roof support structure, the roof having a plurality of demand zones, the method comprising: (a) identifying and mapping the plurality of demand zones of the roof; (b) installing the panels on the roof support structure thereby covering the roof support structure with the metal panels; (c) choosing a strengthening beam tab clip of sufficient length from a plurality of other processes for joining side-adjacent panels to form joints there between, wherein the joining process chosen for each demand zone to form a joint between the side-adjacent panels in that demand zone at least satisfies the performance requirements of that particular demand zone, and whereby the chosen joining process for that demand zone differs from the joining process chosen for at least one other demand zone; and (d) installing the metal panels according to the joining process chosen for each demand zone in step (c).

In many instances utilizing the strengthening beam will eliminate the need for many additional purlins thus substantially reducing the cost of the building structure. Among other things, the reason for this is that the end bay on many buildings is twenty to forty feet long, the high wind zone at the end of the building is normally only ten to fifteen feet wide, if the distance between purlins is reduced to enable a panel with more limited spanning capability to meet the high wind load for this end zone the additional purlins, required only for the building end high load area (usually ten to fifteen feet) must continue on over to the first frame in from the end wall, thus in effect wasting these purlins from the end of the high wind zone to the first frame in from the end wall. However, if the strengthening beam is used to strengthen the panel in the high wind zone the extra purlins do not need to need to be added and they do not need to continue to the first building frame from the end wall.

The strengthening beam clip 300 has a hook portion 306 configured to fit over a similarly configured male sidelap, and it has a plurality of spaced apart notches 308 like the notches of, and for the purpose discussed above for, the clip 100 (FIGS. 21-21A). Further, a plurality of ribbed embossments 310 (like the embossments 124 in the clip 100) are provided in the upstanding web of the clip tab 302 to stiffen and reinforce the clip tab 302.

Figure 51:
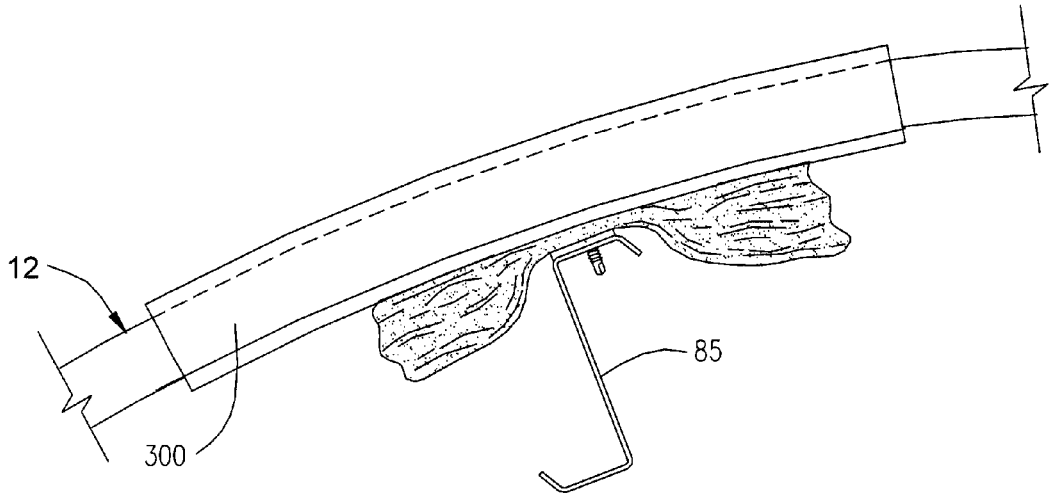
FIG. 51 is an enlarged portion of that depicted in FIG. 50 at one of the underlying support structurals.

FIG. 51 depicts panels 12 connected at the standing seam 10 by the long strengthening beam 300 to underlying structurals 85, such as purlins, in a loaded configuration. Under uniform downwardly directed live loading, the panel seam 10, with strengthening beam clips 300, will deflect in a curved shape in which the upper portions of the strengthening beam clips 300 are in tension over the support structurals 85; this reverses at the P.I. as the lower portion goes into tension. Of course, the reverse of this will occur when the panels 12 are subjected to a uniform upwardly directed load, such as by wind.

The strength of the long strengthening beam, or panel clip tab, 300 can be varied by modifying the cross-section configuration, material strength, thickness or length such as shown in FIGS. 38, 39, 39A and as disclosed for the clip base discussed here so far. The length of the reinforcing or strengthening beam 300 can be varied by providing a long tab that can be cut into multiple tab cut lengths either in the factory or in the field. If cut in the field, the panel reinforcing beam tab can be provided in strips that can be cut on construction site to such lengths required for a particular job, and then assembled to a suitable clip base for installation.

Specific panel strengthening beam strengths and configurations can be determined by accepted panel test procedures. The accepted practice is to test certain tab lengths and strengths, and then interpolate the strength of intermediate length and strength clip tabs.

In considering the suitability of a metal panel roof to sustain the wide range of loading conditions that can be expected in its area of service, the controlling engineering design principles will now be reviewed for such roof. The longitudinally extending metal panels of the roof, presumably being well seamed at the standing seam sidelaps, as well as the panel corrugations, act as multi-span continuous structural beams that are alternately subjected to inwardly directed live loading (such as the weight of snow) and outwardly directed live loading (such as upwardly directed forces imposed by wind). The total beam strength of the panel corrugation seam is substantially proportional to the strength of the corrugation plus any beam reinforcing applied to it.

The roof should also withstand shear and torsional loads when the building is subjected to horizontal loading, such as that imposed by an earthquake, and it will be capable of withstanding such horizontal loading if properly anchored to the underlying building structurals. When attached by floating clips, the roof can be attached to the building perimeter structure so that the roof will transfer loading perpendicularly to a shear wall.

In the case of roof panels with substantially flat sections between spaced apart corrugations, these can be strengthened by applying additional corrugations, generally from about one inch wide and one fourth deep, in various shapes to reinforce the panel areas between corrugations for shear and torsional strength and stability, so that these areas are commensurate in strength to that of the panel interconnected sidelaps.

Figure 50:
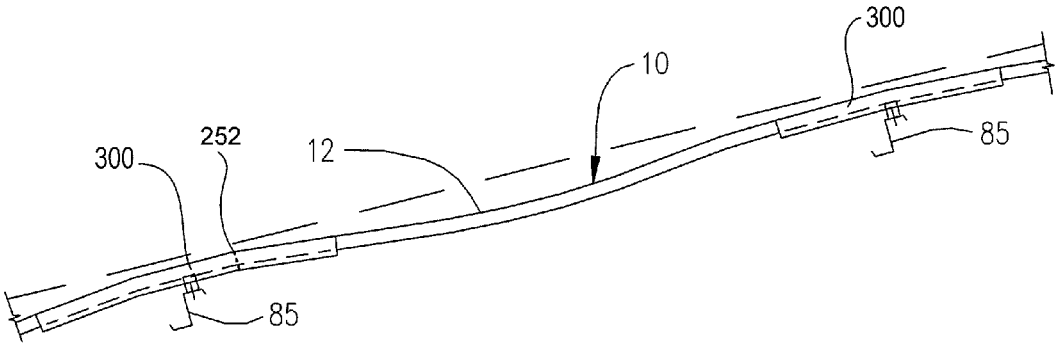
FIG. 50 is a semi-detailed representation of the roof panels and the standing seam of FIG. 2 with the elongated clips and strengthening beams of FIG. 47 as attached to underlying support structurals deflected under a loaded configuration.
Figure 4B:
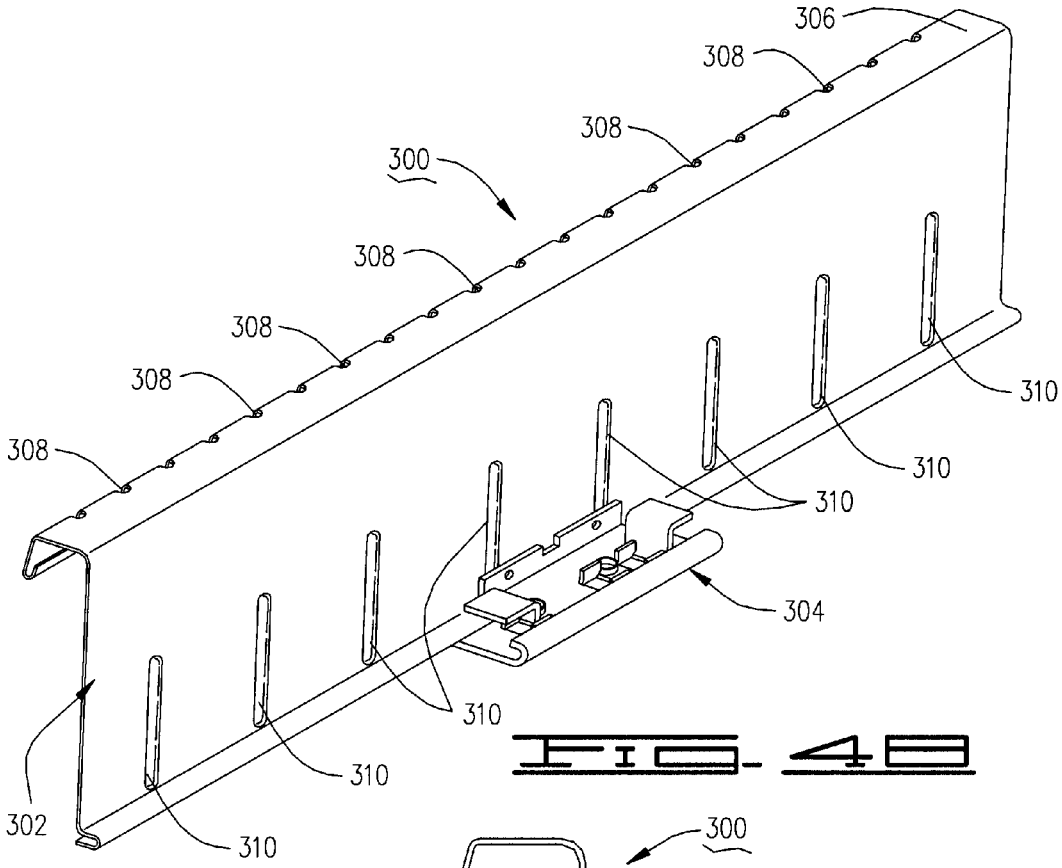
Figure 4B:
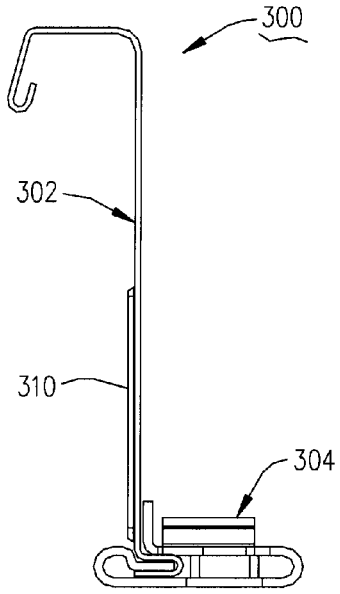

As will be understood by one skilled in the art of pre-engineered building construction and design, the design specifications will first consider the roof under typical uniform loading, and shear and moment diagrams (not shown) will be undertaken to predict the operational performance. When roof panels are resisting inward or outward loading, peak moment and shear occur at inboard support points (medial to the panel lengths), and moment stress drops off very rapidly as the point of inflection (P.I.) is approached. Shear stress likewise drops off rapidly. Because of this, it is desirable that the strength of the panel be varied, particularly at the standing seams, as the shear and moment stress increase; this means that the location of any splice that may be necessary should be located in close proximity to the minimum stress points as feasible. Likewise in the loaded condition as depicted by FIG. 50, another point of discontinuity 252, such as the location of maximum deflection in these depicted embodiments, can be identified for placement of the reinforcing beam 300 as required for a particular application.

Prior art panel splice points (particularly at endlaps) can constitute moment and shear splices, or hinge point splices, that are capable of transferring shear, but which do not transfer substantial moment force. It is preferable to locate moment hinge (splices) point as near as possible to the point in the panel where moment stress drops to zero and bending stress changes from positive to negative, even though shear stress or force are not minimum at that point, it being often more difficult to transfer moment stress than shear stress in a standing seam panel; however, it is often not possible to locate either moment or shear splices at points of zero stress because of other considerations relating to erection, shipping or manufacturing limitations. The shear at the points of zero moment stress, commonly referred to as points of inflection (P.I.), is normally less than maximum.

Physical testing by standards established for metal roof panels has demonstrated that the endlap connection portions of many metal roofs is weaker than the other portions of the roofs, thereby presenting the potential, and probably the likelihood, of premature panel failures from wind uplift at the endlaps. One reason for such failure is that the panel center (the substantially flat portion) tends to bow up under wind uplift loading. When this occurs, unless the back-up plates at the endlaps bridge between standing seams and are connected to adjacent panels, the standing seams at the endlaps tend to separate, or pull apart, at the panel standing seams, further stressing the panel sidelap connections and increasing the probability of failure.

FIG. 38 provided herein shows one means for incorporating a strengthening beam (250) in a panel corrugation at a point of panel discontinuity (252) that is between building supports (85). The upper portion (254, 256) of the strengthening beam (250) is configured to fit between the male sidelap (16) and cooperating female sidelap (14) so that, when the sidelaps 16, 14 are seamed together to form a standing seam (10), the strengthening beam (250) is bound tightly in the standing seam (10) and bridges across panel endlap discontinuity (252) to reinforces a weak point or area of high stress.

Strengthening beams, such as the strengthening beam 250 of FIG. 38, can optionally be attached to a back-up plate 234, which is a free-standing member not attached to the underlying building structurals or it can be part of a long tab panel clip which would reinforce not only the panel at its point of maximum moment stress but also the splice. FIG. 39 shows a strengthening beam 250A having another configuration that can be used in lieu of the splice reinforcing and which is not attached to a back-up plate or a clip base; the strengthening beam 250A strengthens the standing seam 10B and can be located anywhere along the seam. FIG. 39A illustrates how the standing seam 10B can be further strengthened by seaming deforming of the female and male sidelaps 14, 16, together with the beam 250A, to the tighter bend shown such that all of the legs of these members are substantially parallel to the upstanding leg 26 of the female sidelap 14. It should be noted that, for the bean 250A to be most effective, it must be gripped firmly by the female and male sidelaps 14, 16; otherwise its ability to quickly transfer moment is diminished is diminished.

The elongated, variable length strengthening beam clip tab 300 (FIGS. 48-50) provides a means for reinforcing panels at the interconnected standing seams such that the strength of the panels can readily be configured to meet various load and span lengths required for various geographic loading and panel span conditions. Such strengthening beam panel clips, together with a super strong bases capable of high transfer loads, are especially suitable for use with the standing seams described herein (for example, the standing seam 10 of FIG. 2), together with strong attachments to the underlying building structurals.

It is often not possible to locate a panel endlap at the most desirable location, and it is desirable to transfer both shear and moment through the slice at the endlap. Shear can be transferred through a relatively short splice such as shown in FIGS. 35-37. However, it is extremely difficult to transfer moment forces through short endlaps with prior art clips. However, elongated reinforcing beam clips, such as the clip 300 shown in FIGS. 47-49 described herein below, seamed into the panel corrugation in tight seams of the type shown in FIGS. 2, 4-5, 7 and 39A, can be varied as required to form a strengthening beam bridging across the splice to transfer moment forces through the endlap in the standing seam while still performing the function of a clip. Further, the reinforcing beam clip tab can also be used to prevent web and flange crippling.

Another embodiment of the strengthening beam clip 300 may be used at points where it is desirable to splice the panel at endlaps located between supports. The base portion of this embodiment of the clip can be eliminated and optionally the lower part of the clip tab can be reinforced with various beam strengthening bends such as shown in FIG. 39A. It may be used with a back-up plate 238 as shown in FIG. 36 of the back-up plate 234 shown in FIG. 38; or the partial back-up plate used to lock the flats of the overlapping panels in the same general manner shown in FIGS. 34-37. In this embodiment, the top portion of the strengthening beam is seamed tightly into the panel seam shown in FIGS. 2, 4-5, 7, 39A and 45-46. In this embodiment, the beam should extend from the splice in both directions by a sufficient length to transfer the moment in the splice into the panel seam with out prying any part of the seam components open, i.e., the strengthening beam and panel seam must form a rigid moment transferring splice on both sides of the splice.

It is clear that the present invention is well adapted to carry out the objects and to attain the ends and advantages mentioned as well as those inherent therein. While presently preferred embodiments of the invention have been described in varying detail for purposes of the disclosure, it will be understood that numerous changes may be made which will readily suggest themselves to those skilled in the art and which are encompassed within the spirit of the invention disclosed and as defined in the above description and in the accompanying drawings.

What is claimed is:

1. A standing seam roof assembly formed by overlapping adjacent panels supported by a plurality of underlying support structurals, the standing roof assembly comprising:

a first pair of overlapping panels including a first panel having a female sidelap forming a male insertion cavity and a second panel having a male sidelap engageable in the male insertion cavity to form a first portion of a standing seam;

a second pair of overlapping panels including a third panel having a female sidelap and a fourth panel having a male sidelap to form a second portion of the standing seam, the first and second portions of the standing seam joined at an endlap between two adjacent underlying support structurals of the plurality;

a clip base operably attached to only one of the two adjacent support structurals; and a seam reinforcing beam connected to the clip base, the seam reinforcing beam having a web that is operably seamed between both pairs of overlapping panels and selectively sized to extend continuously from a first portion of the web that is directly over the clip base to a second portion of the web that is at the endlap, the web simultaneously strengthening both the first and the second portions of the standing seam between the two adjacent support structurals.

2. The roof assembly of claim 1 wherein the female sidelap of the first panel has a hook portion forming a female retaining groove and the male sidelap of the second panel having a male tab member, the male tab member disposed in the female retaining groove, the female and male sidelaps of the first and second panels seamable such that the hook portion and the male tab member are tightly brought into adjacency to form the standing seam between the first and second panels.

3. The roof assembly of claim 1 wherein the female sidelap of the first panel has a hook portion forming a female retaining groove and the male sidelap of the second panel having a male tab member, the male tab member disposed in the female retaining groove, the female and male sidelaps of the first and second panels foldable such that the hook portion and the male tab member are tightly brought into adjacency to form the standing seam between the first and second panels.

4. The standing seam assembly of claim 3 wherein the seam reinforcing beam is tightly seamed with the seaming of the male and female sidelaps of the first and second panels.

5. A standing seam roof assembly having overlapping panel edges that form a standing seam supported by a plurality of underlying support structurals, the standing seam roof comprising:

a first panel having a female sidelap along one edge thereof that forms a male insertion cavity;

a second panel having a male sidelap along one edge thereof and engagable in the male insertion cavity to form a standing seam; and a seam reinforcing beam having a web configured to be seamed between the male and female sidelaps, and the seam reinforcing beam having a supporting flange operably extending from the web beyond the seamed sidelaps but not connected to any underlying support structural of the plurality of underlying support structurals, the seam reinforcing beam strengthening the standing seam at selected points between adjacent underlying support structurals of the plurality to increase load bearing capacity of the standing seam roof.

6. The roof assembly of claim 5 in which the web has a plurality of notches so that when the female and male sidelaps are seamed, portions of the female and male sidelaps extend into the notches.

7. The roof assembly of claim 5 in which the web has serrated teeth that are disposed to grip selected ones of the male and female sidelap.

8. A standing seam roof assembly having a standing seam formed by seaming overlapping panels that are supported by a plurality of underlying support structurals, the standing seam roof assembly comprising:

a first panel having a female sidelap forming a male insertion cavity;

a second panel having a male sidelap engagable in the male insertion cavity;

a clip base operably attached to only one of the underlying support structurals of the plurality of underlying support structurals; and a seam reinforcing beam connected to the clip base to extend longitudinally substantially orthogonal to the respective underlying support structural, the seam reinforcing beam having a web that is continuously seamed between the first and second sidelaps, a first portion of the web seamed over an entire cross sectional width of the respective underlying support structural to which the clip base is attached, and the seam reinforcing beam selectively sized so that a second portion of the web is seamed at a predetermined point of maximum deflection of the standing seam between two adjacent underlying support structurals of the plurality.

9. The roof assembly of claim 8 wherein the female sidelap has a hook portion forming a female retaining groove and the male sidelap having a male tab member, the male tab member disposed in the female retaining groove, the hook portion and the male tab member are tightly brought into adjacency during seaming to form the standing seam between the first and second panels.

10. The roof assembly of claim 8 in which the web has a plurality of notches so that when the female and male sidelaps are seamed, portions of the female and male sidelaps extend into the notches.

11. The roof assembly of claim 8 wherein the clip and reinforcing beam member form an integrally constructed member.

* * * * *